US011695246B2

(12) United States Patent
Vinther et al.

(10) Patent No.: US 11,695,246 B2
(45) Date of Patent: Jul. 4, 2023

(54) CONTROLLED-IMPEDANCE CABLE TERMINATION FOR CABLES HAVING CONDUCTIVE FOIL SHIELDS

(71) Applicant: Ardent Concepts, Inc., Hampton, NH (US)

(72) Inventors: Gordon A Vinther, Hampton, NH (US); Sergio Diaz, Cambridge, MA (US); Joseph F DiDonna, Lee, NH (US); Michael A Jones, Kingston, NH (US)

(73) Assignee: Ardent Concepts, Inc., Hampton Beach, NH (US)

( * ) Notice: Subject to any disclaimer, the term of this patent is extended or adjusted under 35 U.S.C. 154(b) by 152 days.

(21) Appl. No.: 17/310,223

(22) PCT Filed: Jan. 28, 2020

(86) PCT No.: PCT/US2020/015488
§ 371 (c)(1),
(2) Date: Jul. 27, 2021

(87) PCT Pub. No.: WO2020/160049
PCT Pub. Date: Aug. 6, 2020

(65) Prior Publication Data

US 2022/0140561 A1 May 5, 2022

Related U.S. Application Data

(60) Provisional application No. 62/797,762, filed on Jan. 28, 2019.

(51) Int. Cl.
*H01R 43/28* (2006.01)
*H01R 24/54* (2011.01)
(Continued)

(52) U.S. Cl.
CPC ..... *H01R 43/28* (2013.01); *H01R 24/542* (2013.01); *H01R 25/003* (2013.01); *H01R 24/56* (2013.01)

(58) Field of Classification Search
CPC ..... H01R 43/28; H01R 13/65802; H01R 23/662; H01R 23/688; H01R 13/4532
See application file for complete search history.

(56) References Cited

U.S. PATENT DOCUMENTS 5,281,762 A 1/1994 Long et al.
RE41,663 E * 9/2010 Vinther ..... H01R 13/2421 174/267

(Continued)

FOREIGN PATENT DOCUMENTS

DE 29809365 U1 9/1998
JP 2017004703 A 1/2017
WO 2016072986 A1 5/2016

*Primary Examiner* — Phuong Chi Thi Nguyen
(74) *Attorney, Agent, or Firm* — Altman & Martin; Steven K Martin

(57) ABSTRACT

A cable termination that enables the attachment of SMA connectors to controlled-impedance cables with a conductive foil wrap shield; for the separate ferrule embodiment, the sheath is stripped back on the cable, exposing the foil shield surrounding the dielectric; a ferrule is slid or clamped over the foil shield and bonded; the face of the ferrule is dressed so that the foil shield and dielectric are flush with the ferrule face and the signal conductor protrudes from the face this cable subassembly is installed in the boss of a housing that prevents movement of the ferrules relative to each other and so that each ferrule face is aligned with an opening in the boss through which an SMA connector barrel is attached to the ferrule a cover secures the cable subassembly in the housing.

35 Claims, 25 Drawing Sheets

(51) Int. Cl.
*H01R 25/00* (2006.01)
*H01R 24/56* (2011.01)

(56) References Cited

U.S. PATENT DOCUMENTS

| | | | | |
|---|---|---|---|---|
| 9,645,172 | B2 | 5/2017 | Santos et al. | |
| 10,992,068 | B2 * | 4/2021 | Suzuki | H01R 9/0512 |
| 11,205,877 | B2 * | 12/2021 | Diaz | H01R 13/6591 |
| 11,211,744 | B2 * | 12/2021 | Zhu | H01R 12/7005 |
| 11,316,294 | B2 * | 4/2022 | Flaherty, IV | H01R 13/6275 |
| 11,469,530 | B2 * | 10/2022 | Guo | H01R 13/512 |
| 2007/0093120 | A1 | 4/2007 | Hardy et al. | |
| 2014/0131096 | A1 | 5/2014 | Silverman et al. | |
| 2017/0236621 | A1 | 8/2017 | Silverman et al. | |
| 2019/0058291 | A1 | 2/2019 | Yang et al. | |
| 2022/0104314 | A1 * | 3/2022 | Jones | H05B 3/06 |

* cited by examiner

CONTROLLED-IMPEDANCE CABLE TERMINATION FOR CABLES HAVING CONDUCTIVE FOIL SHIELDS

TECHNICAL FIELD

The present invention relates to electrical cable terminations, more particularly, to terminations for controlled impedance cables made with conductive metal foil shields or composite metal foil and plastic as ground return paths, which are less expensive to manufacture, more flexible and generally used to transmit high frequencies in electronic equipment.

BACKGROUND ART

The purpose of a cable termination is to provide an interconnect from the cable to the electrical device and to provide a separable electrical interconnection between the cable and its operating environment. The characteristic of separability means that the cables are not interconnected by permanent mechanical means, such as soldering or bonding, but by temporary mechanical means.

The typical controlled impedance cable has one or more a signal conductors, each surrounded by a dielectric. The dielectric is surrounded by ground shield and, optionally, the ground shield is covered by a sheath. A cable can have one signal conductor (coax), two signal conductors (twin-ax), three signal conductors (tri-ax), or more, each with its own dielectric. Each conductor/dielectric can have its own ground shield or a single ground shield surrounds all of the conductor/dielectrics. Different ground shield structures are available although all are conductive, including woven wire, metallized wraps, and foil wraps. Of these different ground shield structures, foil wraps are less expensive to manufacture, more flexible and generally used to transmit high frequencies in electronic equipment.

In order to maintain a good mechanical contact in an attempt to minimize detrimental electrical effects of the termination, SMA (SubMiniature Version A) connectors and variations thereof are routinely connected to controlled impedance cables that have return or ground shields that have some structural integrity, like a metal braid in standard flexible cable or a thin metal jacket, like those used on semi-rigid coaxial cables. These cables can easily be soldered to and the connector will not fail at the union of the ground shield and the connector because the shield has structural integrity on its own.

Foil-wrapped cables are smaller and denser, but lack the structural integrity needed to attach the SMA connector because the foil is very thin and designed to be flexible and have less volume.

DISCLOSURE OF THE INVENTION

The present invention is a cable termination that enables the attachment of SMA connectors to controlled-impedance cables with a conductive foil wrap shield. The cable termination provides rigidity and strain relief to the cable and a means for controlling signal integrity and phase length.

The present invention has two embodiments, the separate ferrule embodiment and the integrated ferrule embodiment.

For the separate ferrule embodiment, the sheath is stripped back on the cable, exposing the foil shield surrounding the dielectric to form a shielded line. Alternatively, the dielectric is also stripped back and replaced by a dielectric sleeve. If the cable has single foil shield around all of the dielectrics, the foil shield is split and rewrapped around each dielectric.

A rigid ferrule is slid or clamped over the foil shield and optionally bonded to the shielded line to give the cable the structural integrity needed for attaching an SMA connector barrel. The face of the ferrule is dressed so that the foil shield and dielectric are flush with the face and the signal conductor protrudes from the face. Precise dressing is used to set the electrical length of the cable. In the case of a twin-ax cable, the shielded lines can be precisely matched, as desired.

This cable subassembly is installed in the boss of a housing and secured by a cover attached to the boss. The boss has features for capturing the ferrules and preventing movement of the ferrules relative to each other. The features position the cable subassembly so that each ferrule face is aligned with a corresponding connector opening in the side of the boss. Once the cable subassembly is positioned in the boss, each SMA connector barrel is attached to the ferrule through the opening.

After the SMA connector barrels are attached, the cover is placed on the boss and attached. The cable is pinched between the boss and the cover to provide strain relief.

For the integrated ferrule embodiment, the sheath is stripped back, and the foil shield is stripped back a bit less. If the cable has separate dielectrics, the dielectrics are not stripped back leaving each line and forming the cable subassembly. If the cable has a single dielectric, the dielectric is stripped back with the foil shield and dielectric sleeves are slid over the signal conductors, thereby forming the cable subassembly. The signal conductors are bent away from each other at an angle.

The cable subassembly is installed in the boss of a housing and secured by a cover. The boss has several depressions for receiving the cable subassembly. Each of the depressions has a corresponding depression in the cover, the combination of which form spaces in the housing through which the cable subassembly extends.

The cable fits into a strain relief at one end of the housing. The strain relief opens into a junction space which accepts the cable junction where the signal conductors separate. A neck compresses the foil shield in order to provide an electrical connection between the foil shield and the housing. The signal conductor/dielectrics fit in signal runs that extend away from the junction space at the same angle that the signal conductors are bent away from each other. The signal runs extend through projections that extend from the edge of the housing to openings in the projection faces. The signal conductor protrudes from the projection face.

After trimming and/or dressing the projection faces, the SMA connector barrels are attached to the projections by whatever means is appropriate.

Objects of the present invention will become apparent in light of the following drawings and detailed description of the invention.

BRIEF DESCRIPTION OF DRAWINGS

For a fuller understanding of the nature and object of the present invention, reference is made to the accompanying drawings, wherein.

BEST MODES FOR CARRYING OUT THE INVENTION

Figure 8:
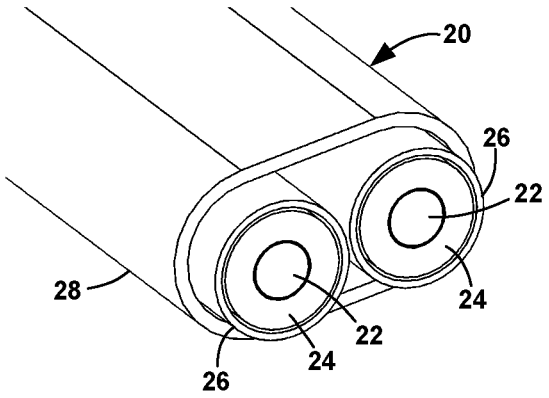
FIG. 8 is an isometric view of the end of the twin-ax cable with separate dielectrics and ground shields.
Figure 9:
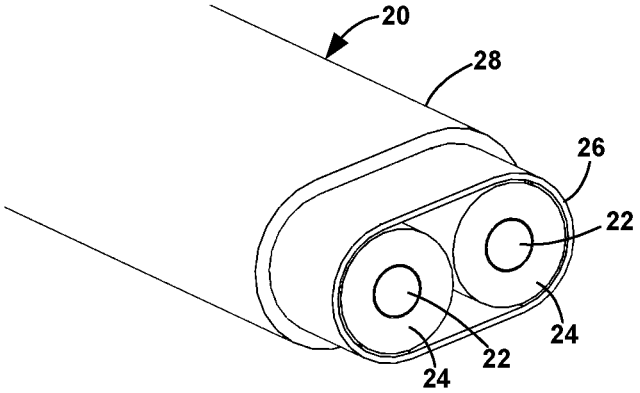
FIG. 9 is an isometric view of the end of the twin-ax cable with separate dielectrics and a single ground shield.
Figure 10:
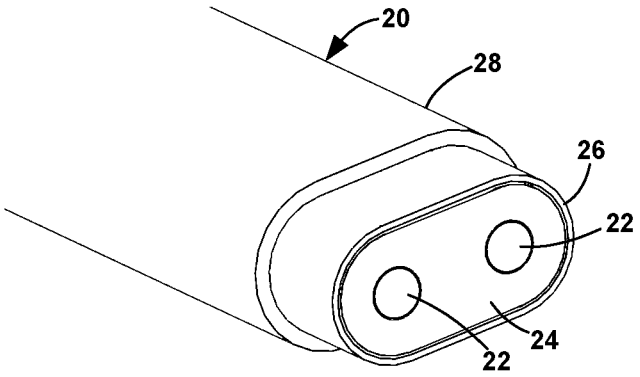
FIG. 10 is an isometric view of the end of the twin-ax cable with a single dielectric and a single ground shield.

As described above, the typical controlled impedance cable 20 has one or more signal conductors 22 each surrounded by a dielectric 24. The dielectric 24 is surrounded by a ground shield 26 and, optionally, the ground shield 26 is covered by one or more sheathes 28*a*, 28*b* (collectively, 28). A cable 20 can have one (coax), two (twin-ax), three (tri-ax), or more signal conductors 22. In some cable structures, each signal conductor 22 has its own dielectric 24 and ground shield 26, as in FIG. 8. In other cable structures, each signal conductor 22 has its own dielectric 24 and a single ground shield 26 surrounds all of the dielectrics 24, as in FIG. 9. In yet another cable structure, a single dielectric 24 surrounds all of the signal conductors 22 and single ground shield 26 surrounds the dielectric 24, as in FIG. 10. The present specification uses several terms to identify different combinations of a cable elements. A line 30 is a combination of a signal conductor 22 and a dielectric 24. A shielded line 32 is a combination of a signal conductor 22, dielectric 24, and shield 26.

The present invention is for use with cables 20 where the only ground shield 26 is composed of a conductive foil wrap, which can be a metal foil or a composite of metal foil and plastic. The present specification uses the term, foil shield, to refer to the conductive foil wrap ground shield 26. The present invention is not intended for use with cables that have ground or return paths the incorporate anything but a foil shield.

The present invention is a cable termination 10 that enables the attachment of SMA connectors to controlled-impedance cables 20 with a foil shield 26. As described in detail below, the cable termination 10 of the present invention provides rigidity to the cable 20 and provides a strain relief and a means for controlling signal integrity and phase length.

The present invention has two embodiments, the separate ferrule embodiment, shown in FIGS. 1-42, and the integrated ferrule embodiment, shown in FIGS. 43-48.

Briefly, for the separate ferrule embodiment, the sheath 28 is stripped back on the cable 20, leaving the foil shield 26 surrounding the dielectric 24 to form a shielded line 32. A rigid ferrule 40 is slid or clamped over the foil shield 26 and bonded to the shielded line 32 to give the cable 20 the structural integrity needed for attaching an SMA connector barrel 12. This cable subassembly 14 is installed in the boss 60 of a housing 16 and secured by a cover 62 attached to the boss 60 by screws 64 or other mechanical means.

The housing 16 provides a platform where the SMA connector barrel 12 can mechanically attach to the ferrule 40 and prevents the flexure of the bonded joint between the ferrule 40 and the shielded line 32.

Figure 1:
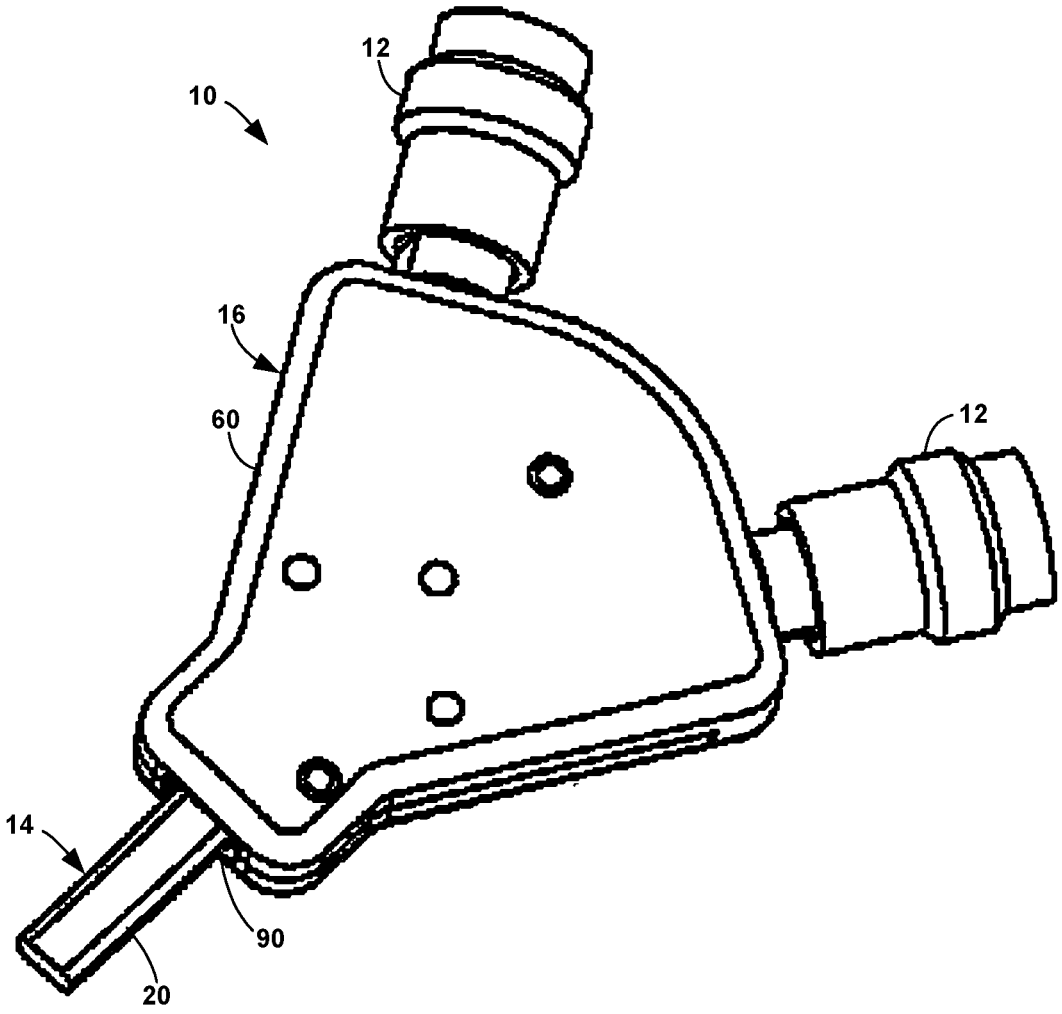
FIG. 1 is a front, isometric view of the fully assembled termination assembly of the separate ferrule embodiment of the present invention for a twin-ax cable.
Figure 2:
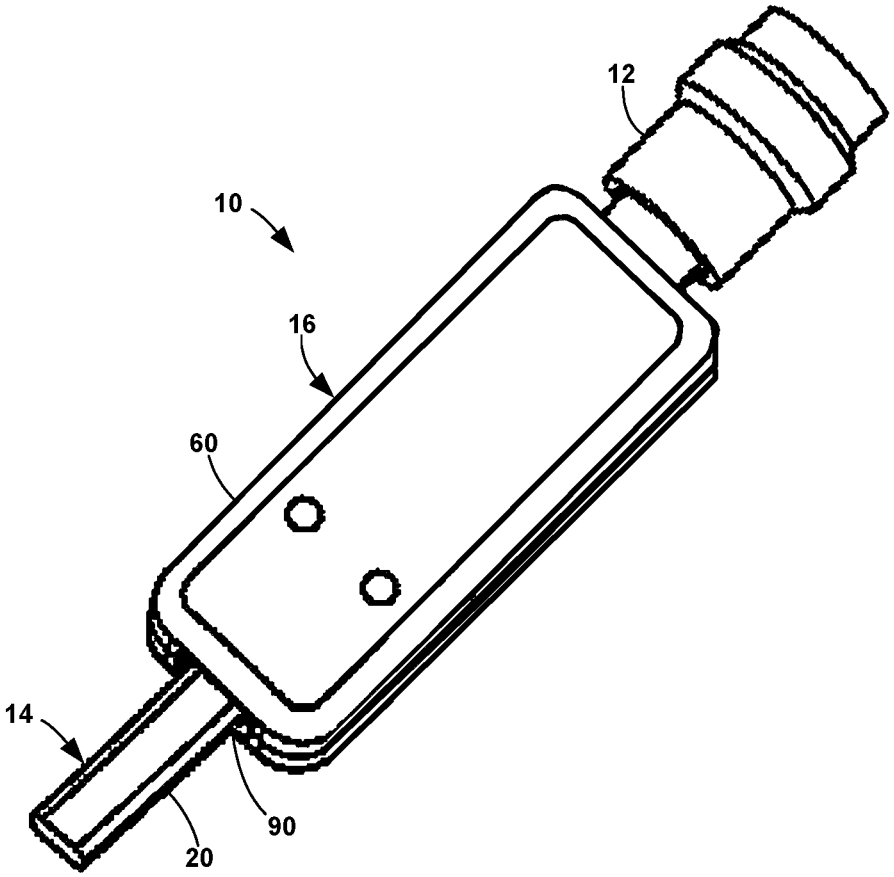
FIG. 2 is a front, isometric view of the fully assembled termination assembly of the present invention for a coax cable.
Figure 3:
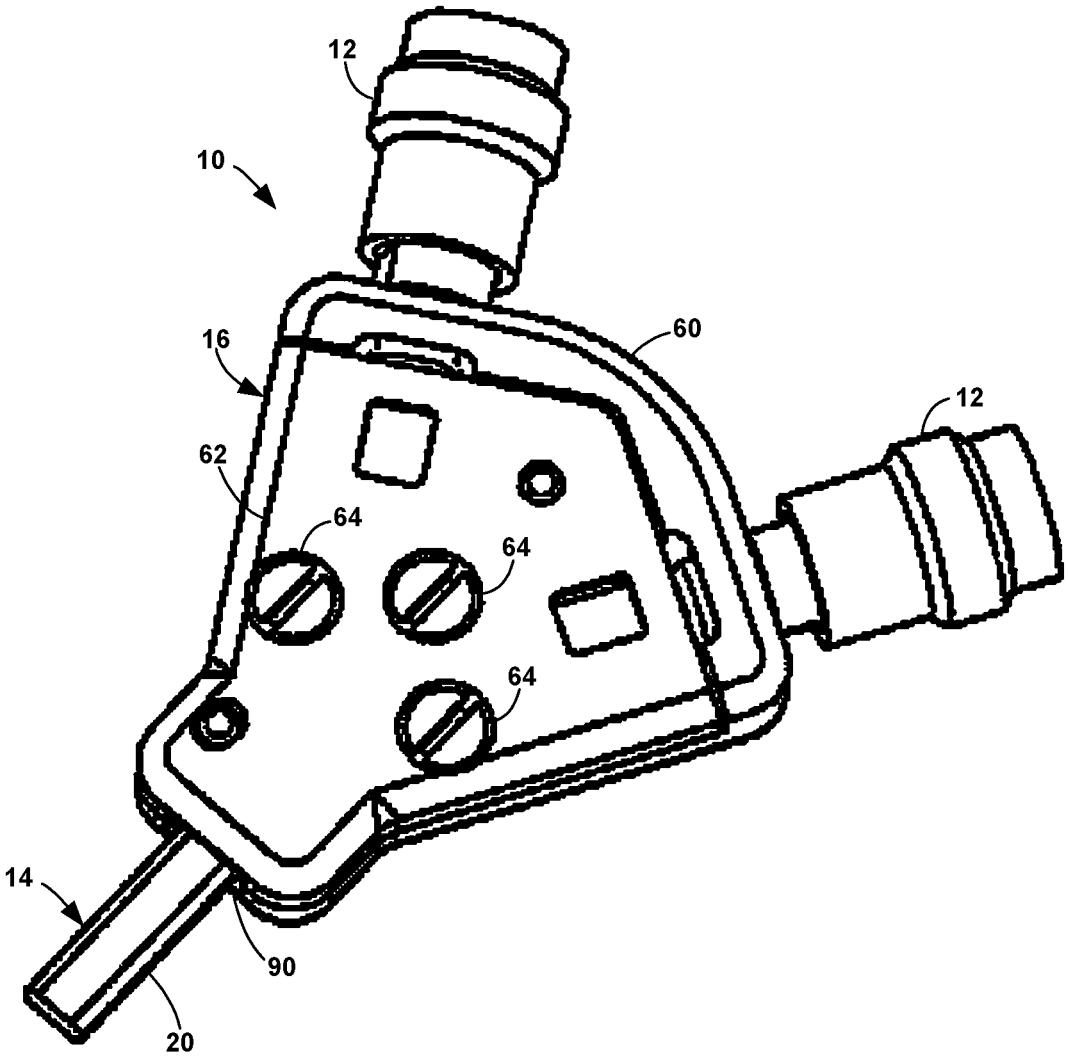
FIG. 3 is a rear, isometric view of the termination assembly of the present invention.
Figure 4:
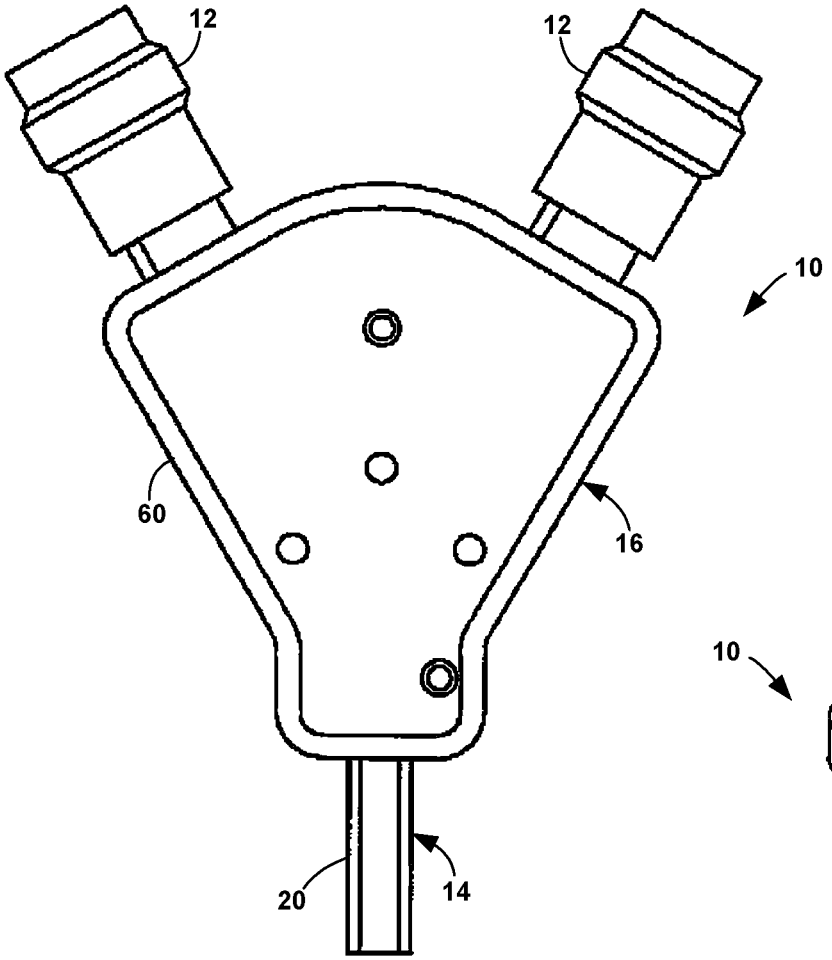
FIG. 4 is a front view of the termination assembly of FIG. 1.
Figure 5:
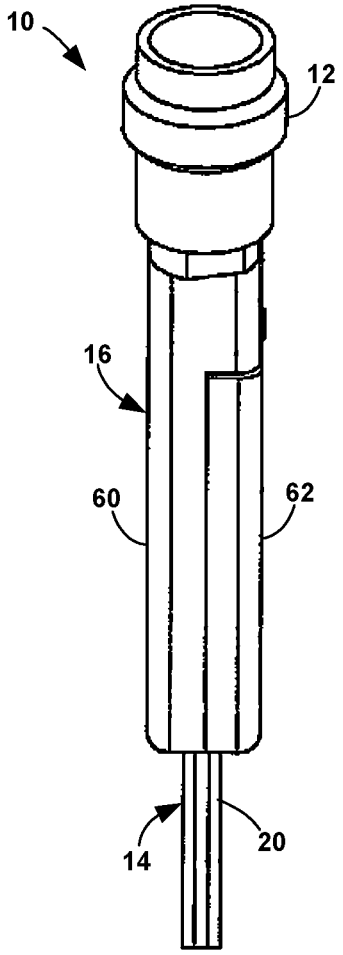
FIG. 5 is a right-side view of the termination assembly of FIG. 1.
Figure 6:
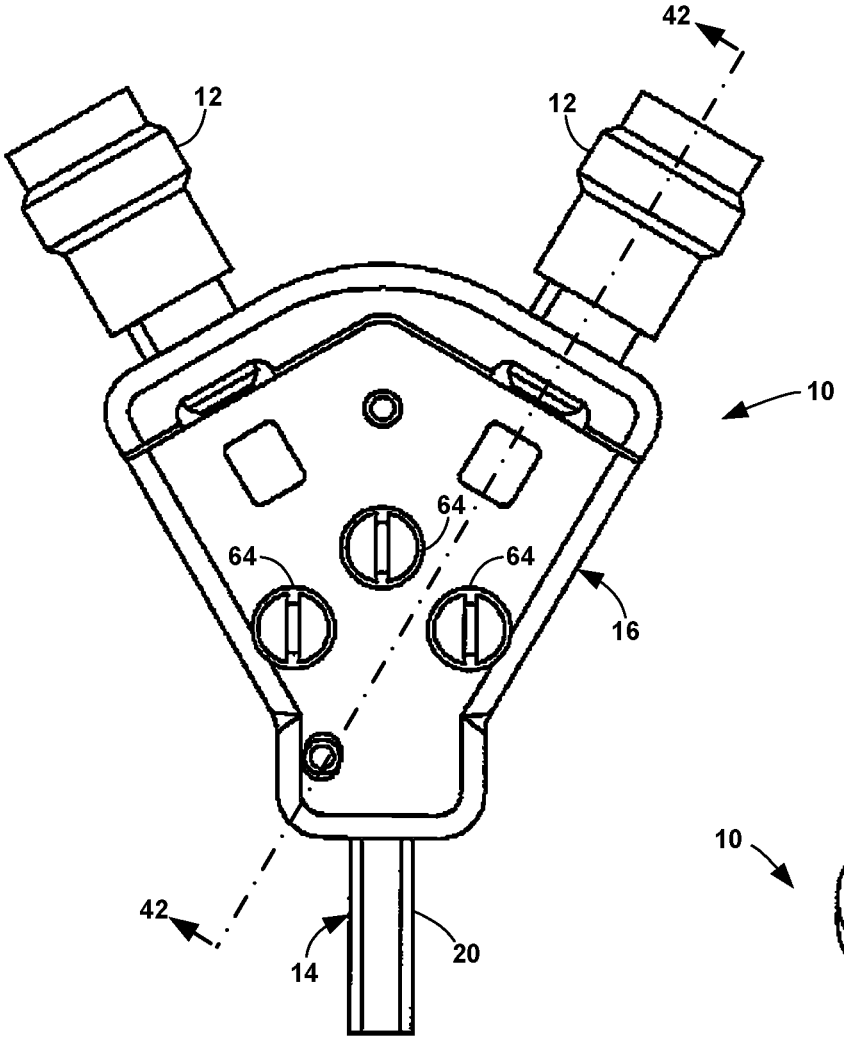
FIG. 6 is a rear view of the termination assembly of FIG. 1.
Figure 7:
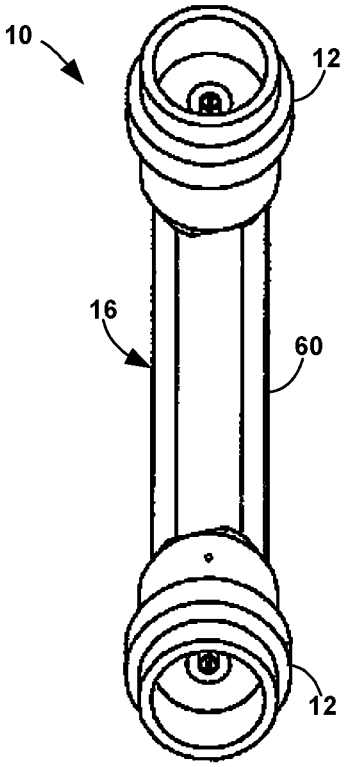
FIG. 7 is a top view of the termination assembly of FIG. 1.

FIGS. 1-7 show the cable termination assembly 10 of the separate ferrule embodiment of the present invention with SMA connector barrels 12. FIGS. 1, and 3-7 show the termination assembly 10 with a twin-ax cable 20 and FIG. 2 shows the termination assembly 10 with a coax cable 20. The present specification describes the termination of the present invention as used with a twin-ax cable 20. However, the present invention can be used with controlled impedance cables 20 having one or more signal conductors 22.

The cable subassembly 14 is assembled by installing a ferrule 40 on each shielded line 32 of the cable 20, as shown in FIGS. 11-34. The sheath 28 is stripped back to expose the foil shield 26 wrapped around the lines 30. The length that the sheath 28 is stripped back, that is, the length of the exposed foil shield 26, will depend on the particular application and the parameters of the housing 16, as described below.

In the case of the cables 20 with more than one signal conductor 22 with a dielectric 24 and foil shield 26 for each signal conductor 22, the shielded lines 32 are merely separated.

Figure 11:
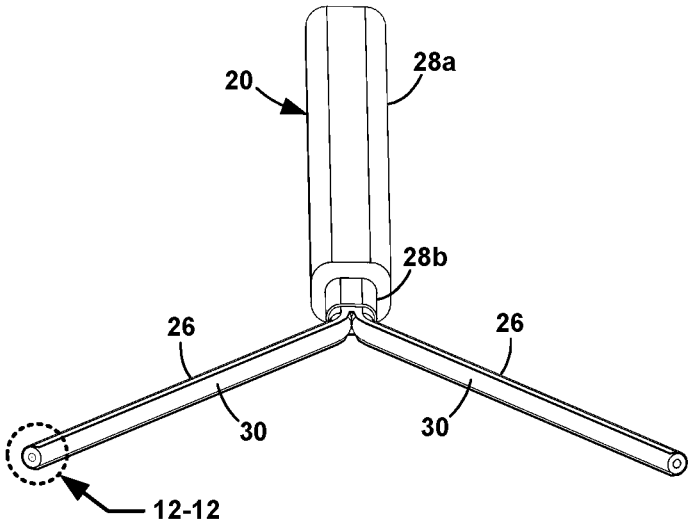
FIG. 11 is a view of the cable at a first step of preparation for assembling the termination to a twin-ax cable with separate dielectrics and a single foil shield.
Figure 12:
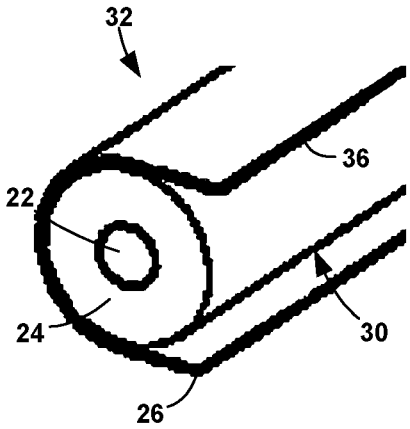
FIG. 12 is a detailed view taken at 12-12 of FIG. 11.
Figure 13:
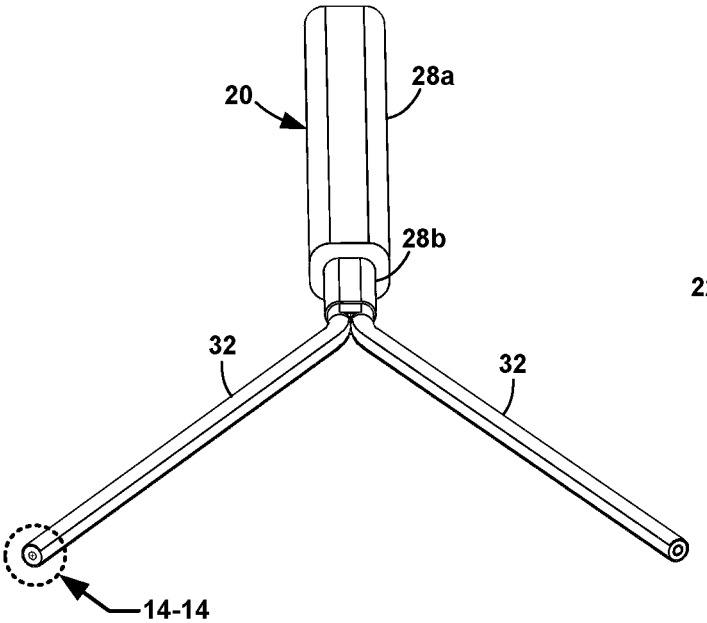
FIG. 13 is a view of the cable at a second step of preparation for assembling the termination to a twin-ax cable with separate dielectrics and a single foil shield.
Figure 14:
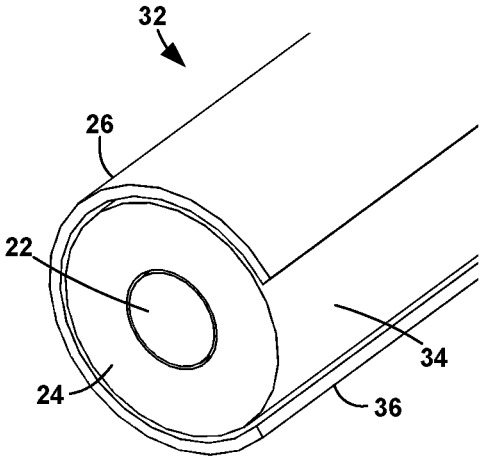
FIG. 14 is a detailed view taken at 14-14 of FIG. 13.

In the case of cables 20 with more than one signal conductor 22 with dielectrics 24 for each signal conductor 22 and a single foil shield 26 surrounding all of the dielectrics 24, the foil shield 26 is split into portions 36, one for each of the lines 30, as in FIGS. 11-12. The split foil shield 26 is re-wrapped around each dielectric 24, as in FIGS. 13-14, to form shielded lines 32. Note that each portion 36 of the cut foil shield 26 is not wide enough to extend around the entire circumference of the dielectric 24, thereby leaving a gap 34 in the foil shield 26 for each shielded line 32, as in FIG. 14. Either condition, the foil shield 26 completely surrounding the dielectric 24 or the foil shield 26 not completely surrounding the dielectric 24, is considered by the present application to be the foil shield 26 surrounding the dielectric 24.

The present invention also contemplates that the dielectric 24 can be stripped back and replaced by a dielectric sleeve. This can be useful when, for example, the impedance of the cable needs to be changed.

Several configurations of the ferrule 40 to be installed on each shielded line 32 of a cable 20 with separate dielectrics 24 are shown in FIGS. 15-23. The ferrule 40 is a cylinder composed of a rigid material. In one form, the ferrule 40 is composed of an electrically conductive material such as brass or copper. In another form, the ferrule 40 is composed of an electrically insulating material.

The ferrule 40 has an axial through bore 42 that extends from a line opening 44 in one end 48 to a face opening 46 in the ferrule face 50 at the other end. The through bore 42 has a diameter such that it can accept the shielded line 32 like that shown in FIG. 14. The ferrule 40 has a capture section 80 that is adjacent to the line opening 44 and an SMA attachment section adjacent to the ferrule face 50.

Figure 18:
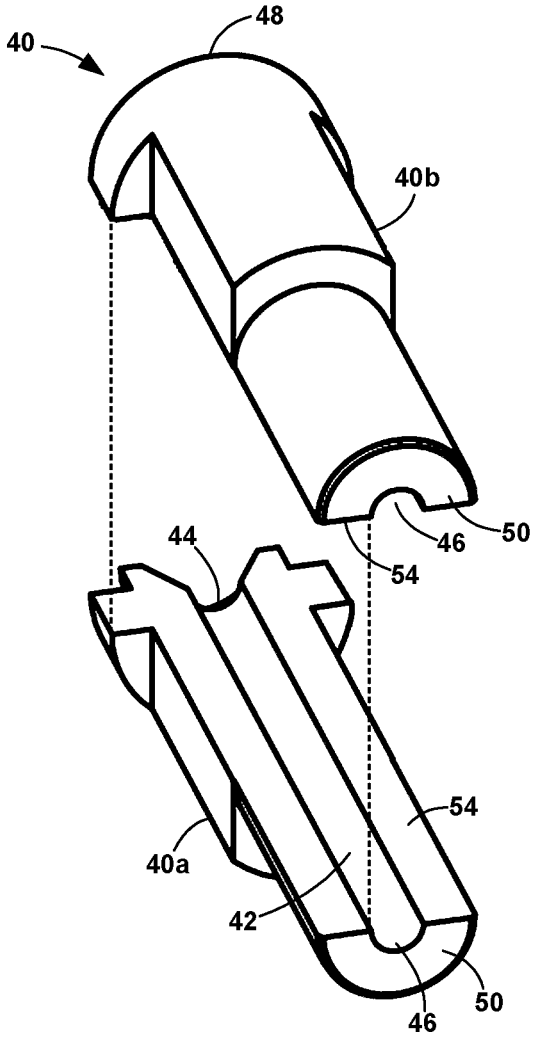
FIG. 18 is an exploded, isometric view of a two-part ferrule.
Figure 19:
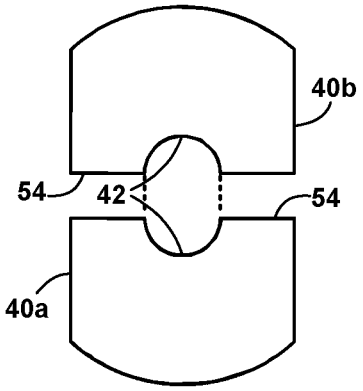
FIG. 19 is an exploded, cross-sectional view of the two-part ferrule of FIG. 18.

Optionally, the ferrule 40 is composed of two longitudinal parts 40*a*, 40*b*, as in FIGS. 18-23, that together comprise the complete ferrule 40. In the configuration of FIGS. 18-19, the two parts 40*a*, 40*b* are identical, that is, each part 40*a*, 40*b* extends around 180° of the ferrule 40.

Figure 20:
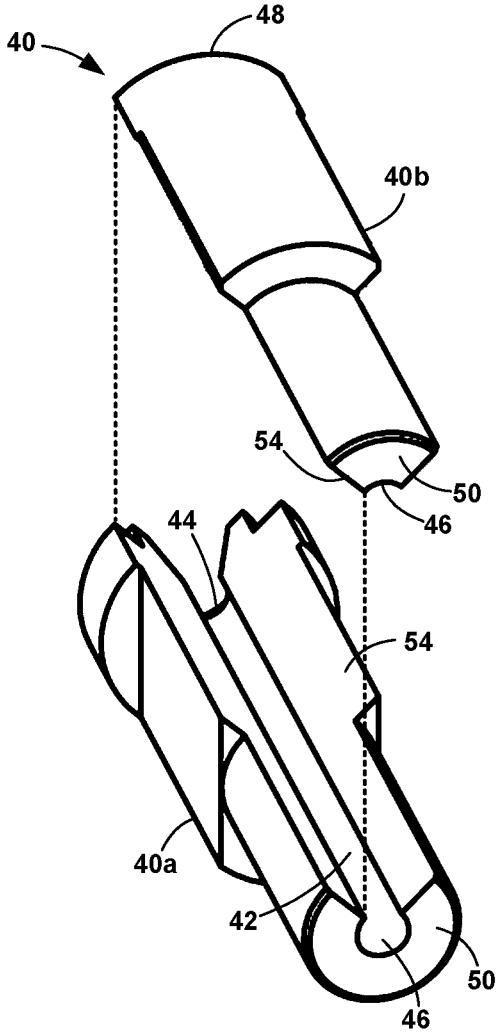
FIG. 20 is an exploded, isometric view of another two-part ferrule.
Figure 21:
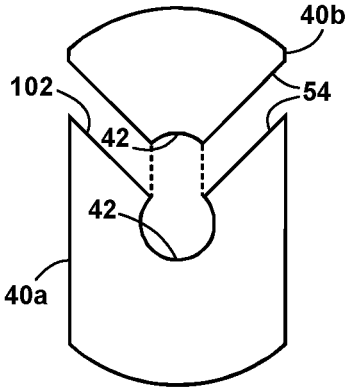
FIG. 21 is an exploded, cross-sectional view of the two-part ferrule of FIG. 20.

In the configuration of FIGS. 20-21, a larger part 40*a* extends over greater than 180° of the ferrule 40, leaving a wedge-shaped notch 102 of less than 180°, and the smaller part 40*b* extends over the angle of the notch 102. In the example of FIGS. 20-21, the larger part 40*a* extends around 270°, leaving a 90° notch 102. This particular shape aids in alignment of the two parts 40*a*, 40*b* when fitting them together.

Figure 22:
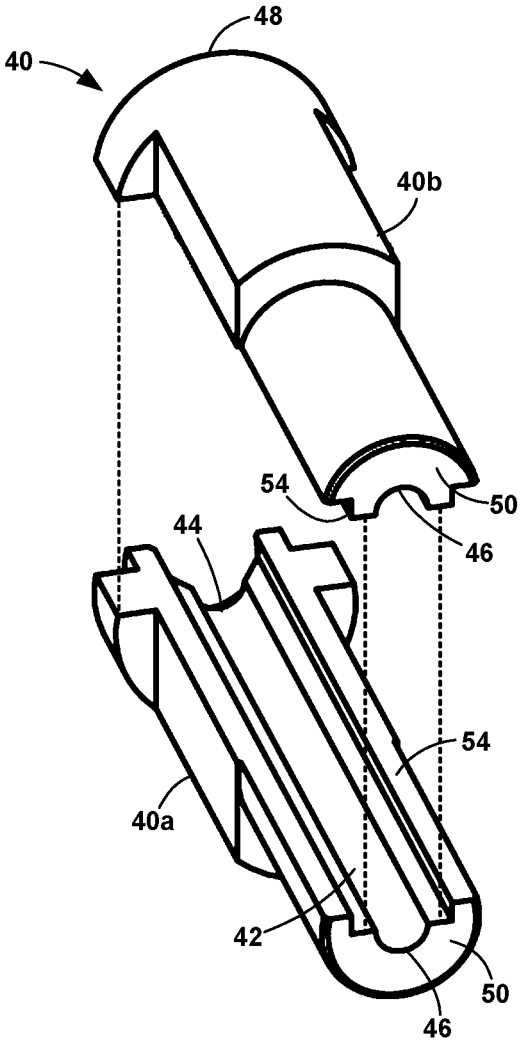
FIG. 22 is an exploded, isometric view of another two-part ferrule.
Figure 23:
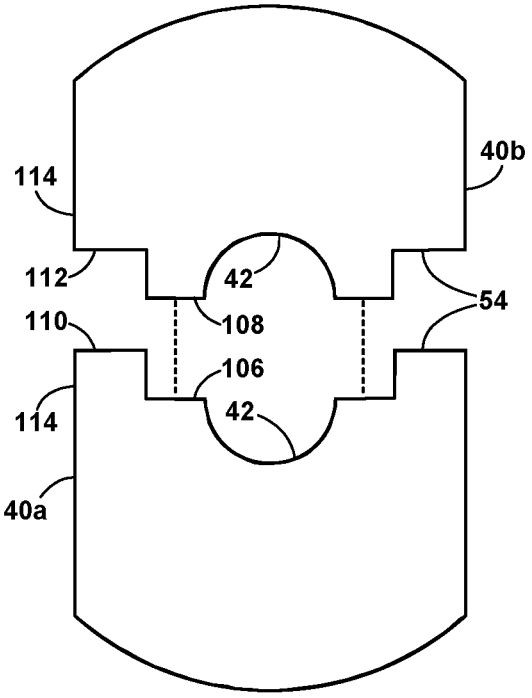
FIG. 23 is an exploded, cross-sectional view of the two-part ferrule of FIG. 22.

In the configuration of FIGS. 22-23, the parts 40*a*, 40*b* are stepped to facilitate alignment when fitting them together. Each of the two parts 40*a*, 40*b* extends around 180° of the ferrule 40. The first part 40*a* has one or two longitudinal grooves 106 adjacent to the bore 42 and the second part 40*b* has mating longitudinal ridges 108 adjacent to the bore 42. The parts 40*a*, 40*b* can also be viewed in an alternative manner where the first part 40*a* has longitudinal ridges 110 adjacent to the outer surface 114 and the second part 40*b* has mating longitudinal grooves 112 adjacent to the outer surface 114. Alternatively, the grooves and ridges are between but spaced from the bore 42 and outer surface 114. This stepped configuration aids in alignment of the two parts 40*a*, 40*b* when fitting them together and helps block signal leakage.

Figure 15:
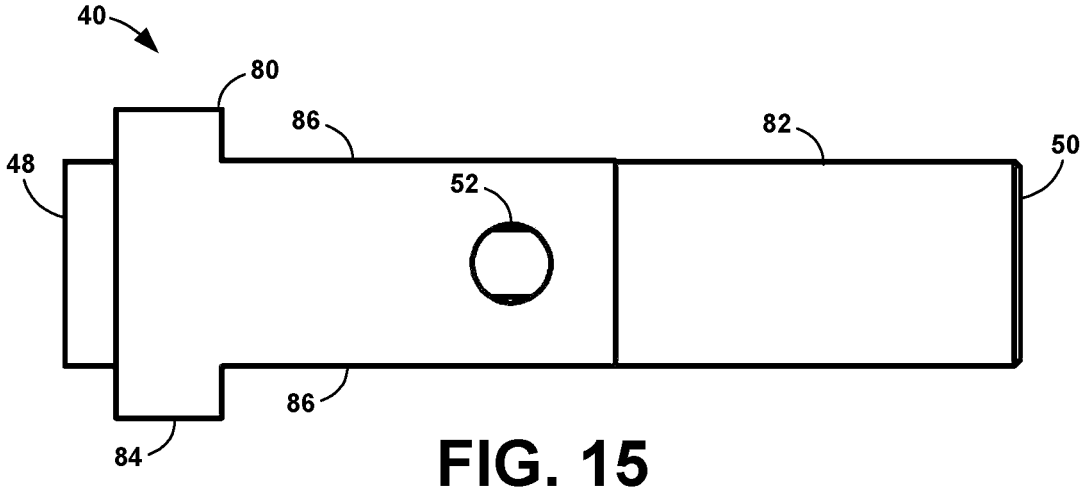
FIG. 15 is a top view of a single-part ferrule.
Figure 16:
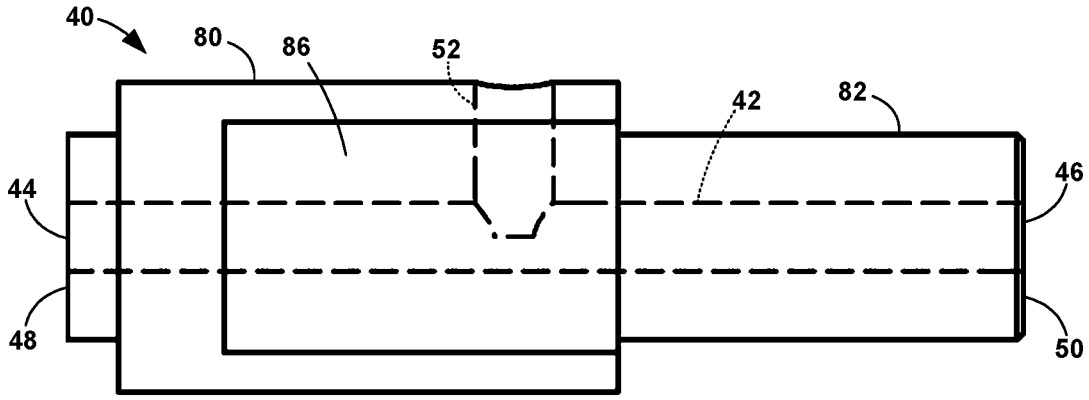
FIG. 16 is a side, partial phantom view of the single-part ferrule of FIG. 15.
Figure 17:
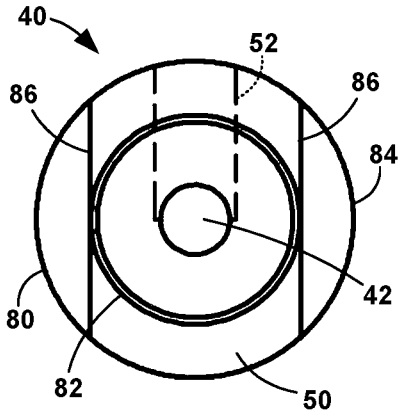
FIG. 17 is a ferrule face end view of the single-part ferrule of FIG. 15.
Figure 24:
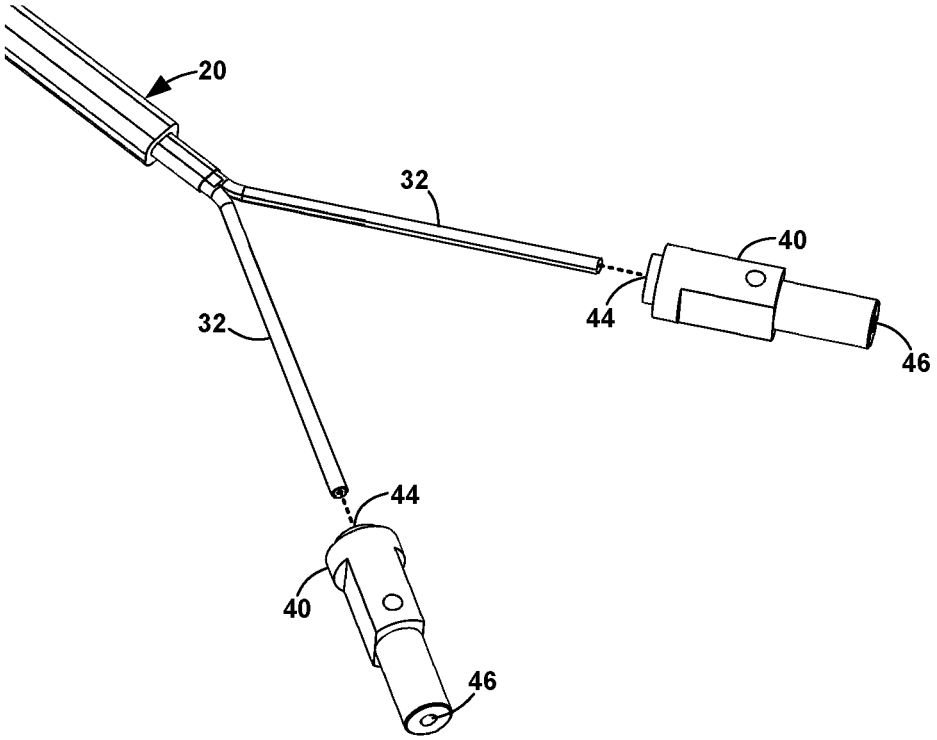
FIG. 24 is an isometric view of single-part ferrules to be installed on shielded lines.
Figure 25:
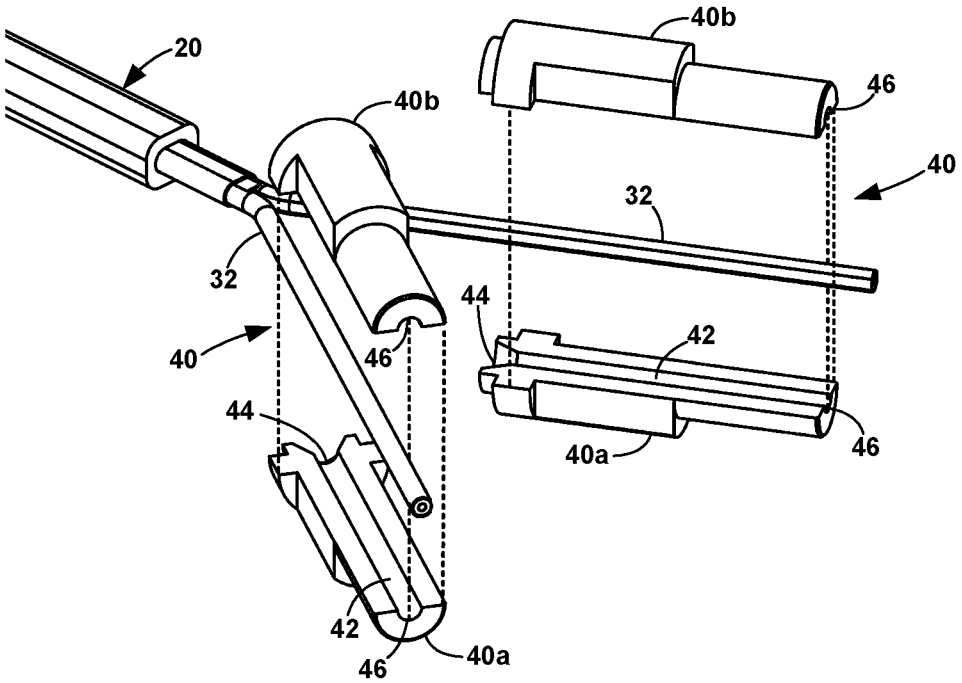
FIG. 25 is an isometric view of two-part ferrules to be installed on shielded lines.
Figure 26:
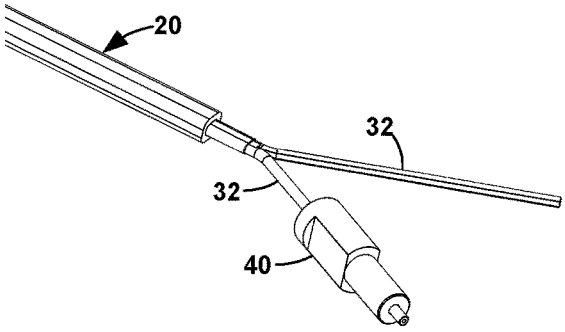
FIG. 26 is an isometric view of the ferrule installed on the shielded line.
Figure 27:
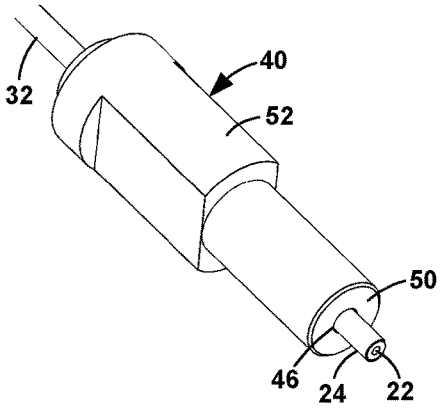
FIG. 27 is a detailed view of the ferrule installed on the shielded line of FIG. 26.

For the single-part ferrule 40 of FIGS. 15-17, the shielded line 32 is inserted into the line opening 44 and the ferrule 40 is slid onto the shielded line 32, as in FIG. 24, until the end of the shielded line 32 extends from the face opening 46, as in FIGS. 26-27. For the two-part ferrule 40 of FIGS. 18-19 and 22-23 and the two-part ferrule 40 of FIGS. 20-21 if the wedge angle is close to 180°, the two parts 40*a*, 40*b* are placed on the shielded line 32 with the longitudinal faces 54 abutting each other, as at FIG. 25, with the end of the shielded line 32 extending from face opening 46, as in FIGS. 26-27. For the two-part ferrule 40 of FIGS. 20-21 where the wedge angle is significantly less than 180°, the shielded line 32 is inserted into the line opening 44 of the first part 40*a* and the first part 40*a* is slid onto the shielded line 32 until the end of the shielded line 32 extends from the face opening 46, as in FIGS. 26-27. Then the second part 40*b* is placed on the shielded line with the two longitudinal faces 54 abutting each other.

The amount of shielded line 32 extending from the face opening 46 depends on the desired length of the shielded line 32 in the cable subassembly 14. Optionally, the foil shield 26 can be trimmed back, but must still be in electrical contact with the ferrule 40 if the ferrule 40 is conductive.

If the ferrule non-conductive, it can be plated with a conductive surface, in which case the foil shield 26 must make electrical contact with the ferrule 40. In the case where the shielded line 32 is a sufficient impedance environment, the ferrule 40 may not be conductive.

In one form, a bonding agent secures the ferrule 40 to the shielded line 32, thereby creating a rigid structure at the end of the shielded line 32. The bonding agent can be introduced to the bore 42 through a bonding agent hole 52 that intersects the bore 42, which aids in cleanly dispensing the bonding agent. Alternatively, the bonding agent is injected into one or both bore openings 44, 46 of the ferrule 40. Alternatively, with the two-part ferrule 40, the bonding agent is put on the halves of the bore 42 before the ferrule 40 is placed on the shielded line 32.

The bonding agent can be any type of adhesive that is adequate for the particular application. The bonding agent may or may not be electrically conductive. The present invention contemplates that the bonding agent can be metal or non-metal, and temperature setting, chemical setting, or radiation setting.

For the two-part ferrule 40, the bonding agent also can be used to attach the two ferrule parts 40*a*, 40*b* together to form the complete ferrule 40. Alternatively, the ferrule parts 40*a*, 40*b* can be attached together using any other means that is appropriate for the application. Examples include soldering, welding, adhesives, clamps, and boss features, as described below.

Figure 28:
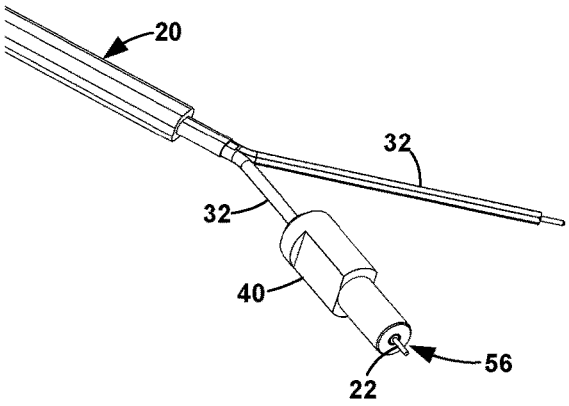
FIG. 28 is an isometric view of the ferrule installed on the shielded line and the ferrule face dressed to receive the connector.
Figure 29:
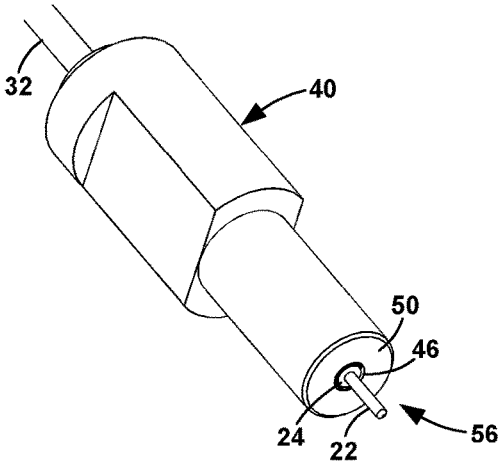
FIG. 29 is a detailed view of the ferrule installed on the shielded line of FIG. 28.

Once the bonding agent is set, the ferrule face 50, dielectric 24, and foil shield 26 (if it is not trimmed back prior to insertion into the line opening 44) are dressed by precise trimming such that the dielectric 24 and foil shield 26 are flush with the ferrule face 50, thereby producing a flat planar mating surface with the unscored signal conductor 22 protruding slightly, as at 56 in FIGS. 28-29. In conjunction with the distance that the ferrule 40 is slid onto the shielded line 32, this precise trimming is also used to set the electrical length or phase of the cable. Trimming the face 50 makes the shielded line 32 electrically shorter. In the case of a twin-ax cable 20, the shielded lines 32 can be precisely matched so that they have the same or specified different electrical length or phase length, as desired.

As indicated above, the ferrule 40 can be composed of an electrically conductive or insulating material. With a conductive material, the ferrule 40 operates electrically as part of the foil shield 26, so that the foil shield 26 does not need to be exposed at the ferrule face 50 after dressing.

If the ferrule 40 is composed of an insulating material, the ferrule 40 does not operate as part of the foil shield 26, so the foil shield 26 must be extended to the ferrule face 50 in some manner. Any means adequate to do so can be employed by the present invention and is considered part of the dressing process. In one form, the ferrule face 50 has an electrically conductive coating that is electrically connected to the foil shield 26. In another, the bonding agent is conductive and extends to the ferrule face 50.

Figure 30:
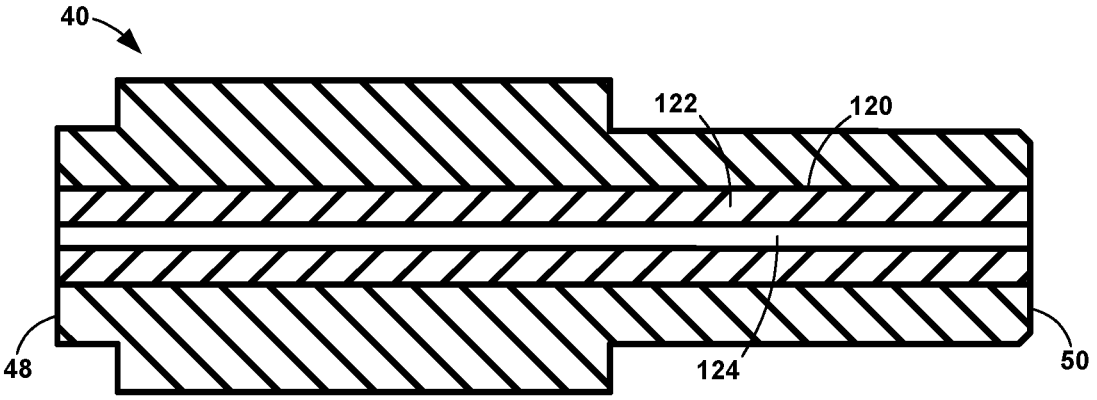
FIG. 30 is a cross-sectional view of a ferrule for cables having multiple signal conductors and a single dielectric.
Figure 31:
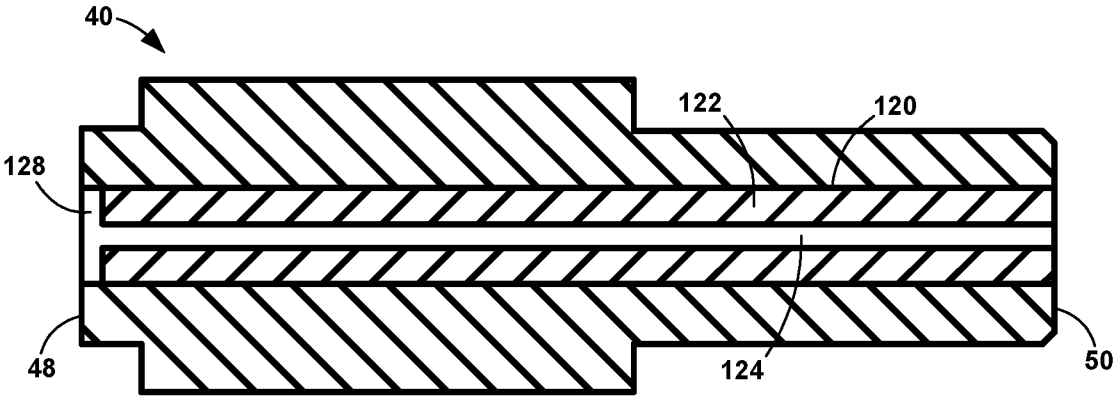
FIG. 31 is a cross-sectional view of another ferrule for cables having multiple signal conductors and a single dielectric.
Figure 32:
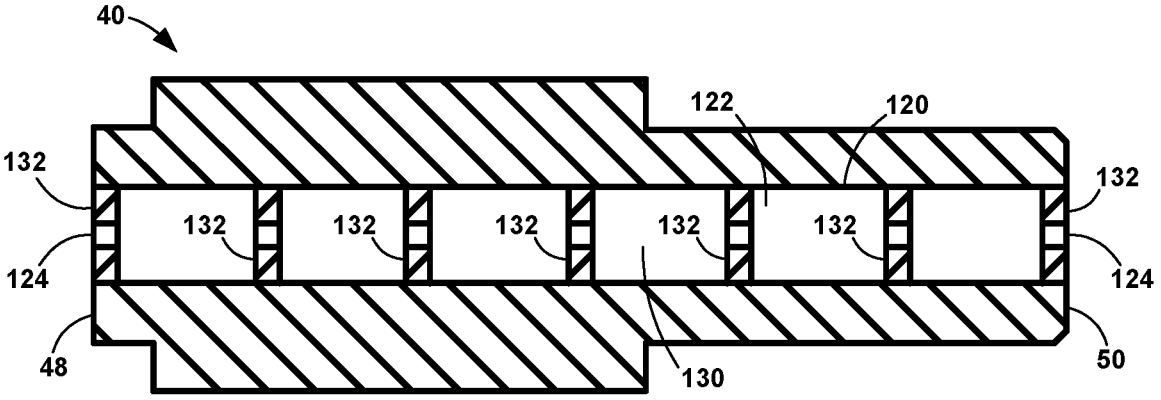
FIG. 32 is a cross-sectional view of another ferrule for cables having multiple signal conductors and a single dielectric.

Several configurations of the ferrule 40 to be installed on each signal conductor 22 of a cable 20 with a single dielectric 24 are shown in FIGS. 30-32. The ferrule 40 is a cylinder composed of a rigid, electrically conductive, material such as brass or copper, with an axial through bore 120. Also, as above, the ferrule 40 can be composed of a single part or two longitudinal parts.

In the configuration of FIG. 30, the ferrule 40 has an integral solid dielectric 122 that resides in the bore 120 and extends the full length of the bore 120. The dielectric 122 has an axial through hole 124 for the signal conductor 22. The dielectric 122 can either be separate from the ferrule 40 or can secured in the bore 120 by press fit or otherwise means. If the ferrule 40 is a two-part ferrule 40, the dielectric can be either a single part or two parts.

The configuration of FIG. 31 is the same as that of FIG. 30, with the addition of a slight depression 128 in the dielectric 122 at the line end 48. The depression 128 provides an anchor for the shielded line 32. As above, the dielectric 122 can either be separate from the ferrule 40 or can secured in the bore 120 by press fit or otherwise means. As above, if the ferrule 40 is a two-part ferrule 40, the dielectric can be either a single part or two parts.

In the configuration of FIG. 32, the ferrule has an air dielectric 130. A plurality of dielectric spacers 132 provide the axial through hole 124 for the signal conductor 22.

Figure 33:
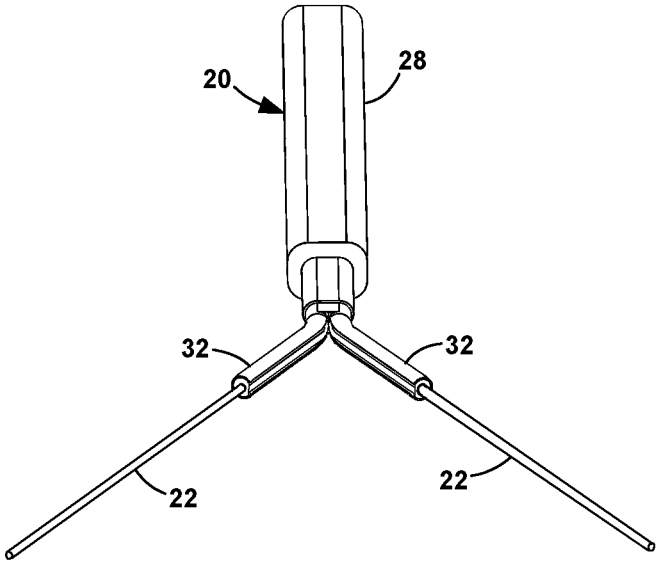
FIG. 33 is a view of the cable after preparation for assembling the termination to a twin-ax cable with a single dielectric.
Figure 34:
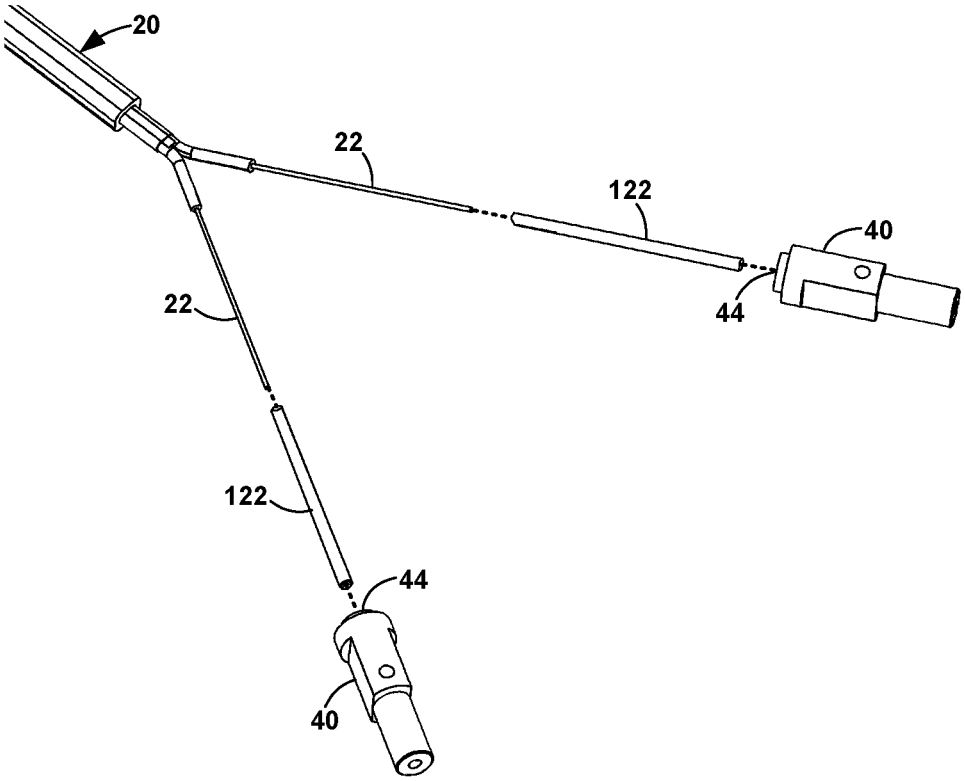
FIG. 34 is an isometric view of single-part ferrules to be installed on signal conductors.
Figure 35:
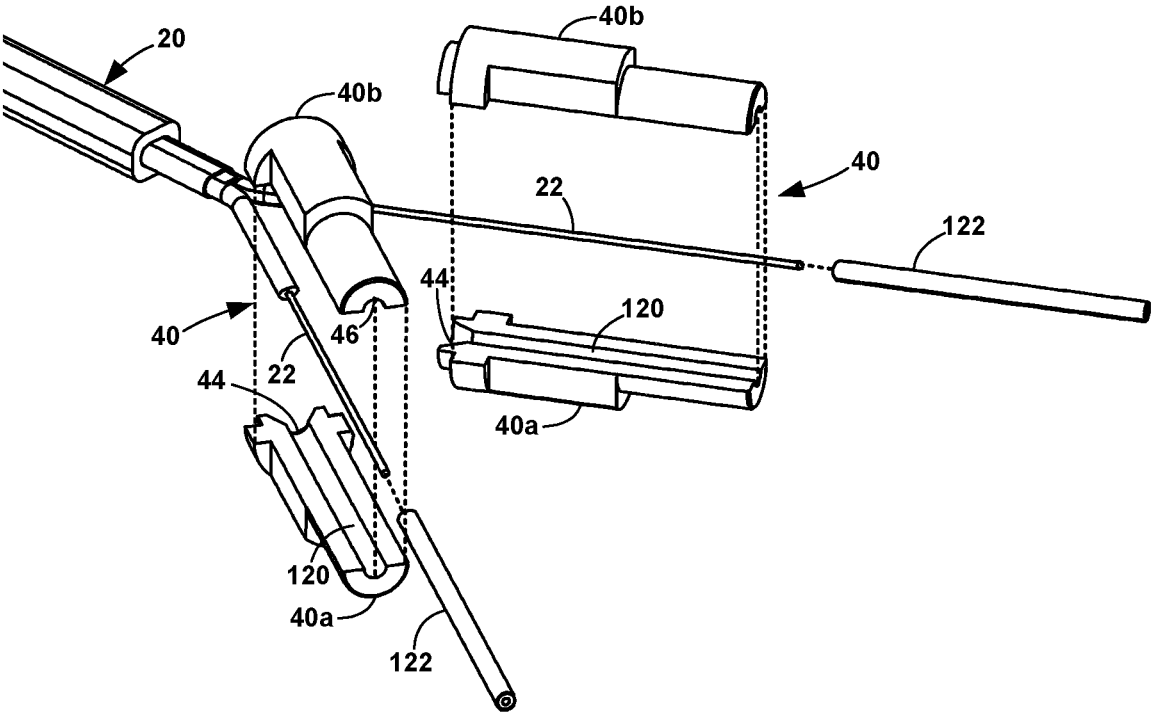
FIG. 35 is an isometric view of two-part ferrules to be installed on signal conductors.

In the case of cables 20 with more than one signal conductor 22 with a single dielectric 24 and a single foil shield 26 surrounding the dielectric 24, prior to installing the ferrule 40, the foil shield 26 and dielectric are split and stripped back, leaving only the bare signal conductor 22, as in FIG. 33.

If the dielectric is separate from the ferrule 40, the dielectric 122 is slid onto the signal conductor 22 until it abuts the trimmed dielectric 24 and foil shield 26. The single-part ferrule 40 is installed on the dielectric 122 by inserting the signal conductor 22/dielectric 122 into the line opening 44 and the ferrule 40 is slid onto the signal conductor 22/dielectric 120, as in FIG. 34, until the dielectric 120 is at the ferrule face 50 and the end of the signal conductor 22 extends from the face opening 46, as in FIG. 36. The two-part ferrule 40 is installed as described above, as at FIG. 35, by placing the two parts on the dielectric 120 with the longitudinal faces abutting each other such that with the end of the dielectric 120 is properly positioned in the bore 120 and the signal conductor extends from the face opening 46, as in FIG. 36.

Figure 36:
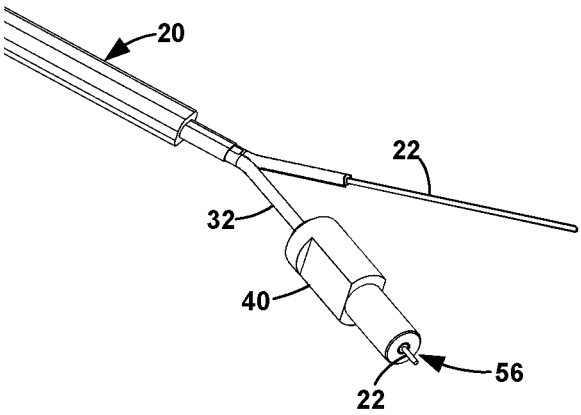
FIG. 36 is an isometric view of the ferrule installed on the signal conductor.

If the dielectric is secured in the bore 120, the single-part ferrule 40 is installed on the signal conductor 22 by inserting the signal conductor 22 into the signal conductor opening 136 and the ferrule 40 is slid onto the signal conductor 22 until the end of the signal conductor 22 extends from the face opening 46, as in FIG. 36. The two-part ferrule 40 is installed as described above by placing the two parts on the signal conductor 22 with the longitudinal faces abutting each other such that the signal conductor extends from the face opening 46, as in FIG. 36.

Optionally, a bonding agent secures the ferrule 40 to the signal conductor 22. As above, the bonding agent can be introduced to the bore 120 through a bonding agent hole that intersects the axial through hole 124. Alternatively, the bonding agent is injected into one or both ends of the axial through hole 124. Alternatively, with the two-part ferrule 40, the bonding agent is put on the halves of the axial through hole 124 before the ferrule 40 is placed on the signal conductor 22.

As above, the bonding agent can be any type of adhesive that is adequate for the particular application. As above, for the two-part ferrule 40, the bonding agent also can be used to attach the two ferrule parts 40*a*, 40*b* together to form the complete ferrule 40. Alternatively, the ferrule parts 40*a*, 40*b* can be attached together using any other means that is appropriate for the application. Examples include soldering, welding, adhesives, clamps, and boss features, as described below.

Once the bonding agent is set, the ferrule face 50 is optionally dressed by precise trimming to set the electrical length or phase of the cable. Trimming the face 50 makes the shielded line 32 electrically shorter. The two shielded lines 32 of a twin-ax cable 20 can be precisely matched so that they have the same or specified different electrical length or phase length, as desired.

Once the face 50 is dressed, the signal conductor 22 is also trimmed so that it protrudes, as at 56, by a length that is determined by the specifications of the desired SMA connector type, typically in the range of from 25 mils to 75 mils.

Figure 37:
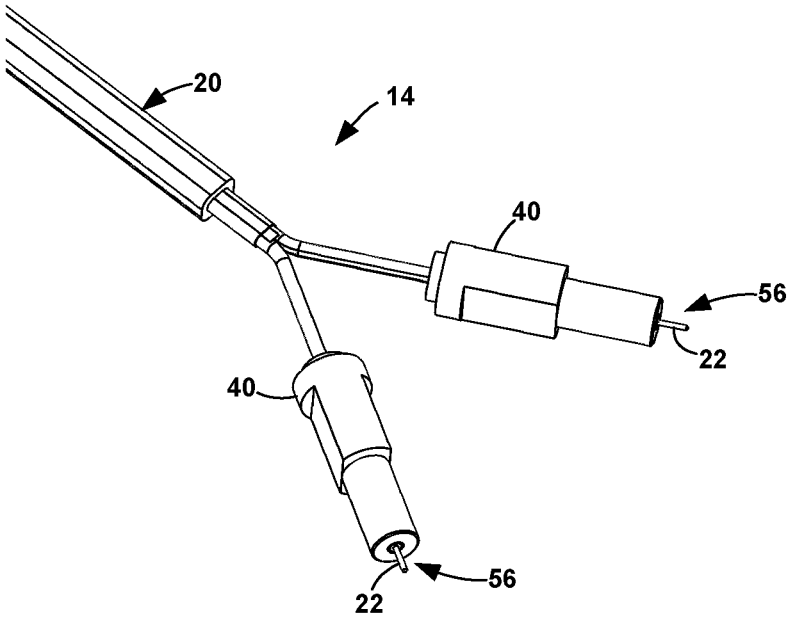
FIG. 37 is an isometric view of the completed cable subassembly.
Figure 39:
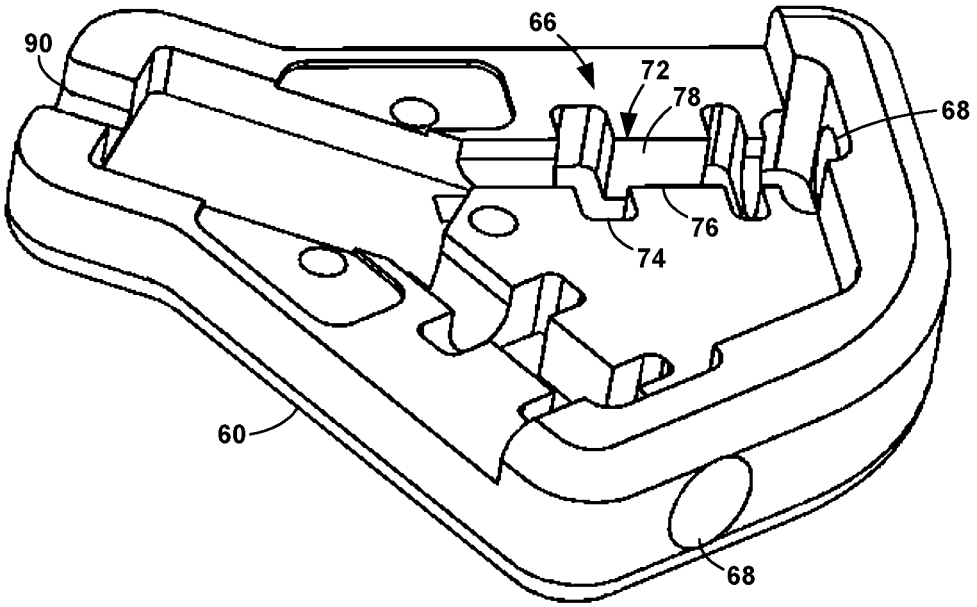
FIG. 39 is an isometric view of the boss with the cable subassembly installed.

After a ferrule 40 is installed on each shielded line 32 and dressed, as shown in FIG. 37, the cable subassembly 14 is ready to be installed into the housing 16.

The housing 16 includes a boss 60 and a cover 62 that are both composed of a rigid material. The boss 60 and cover 62 can be composed of electrically insulating materials or electrically conductive materials. The latter makes for a better EMI shield.

As shown in FIGS. 39-42, the cable subassembly 14 is positioned in the boss 60 by seating the capture section 80 of the ferrules 40 within discrete features 66 in the boss 60 and by seating the cable 20 in the cable opening 90. The features 66 position the cable subassembly 14 so that each ferrule face 50 is aligned with a corresponding connector opening 68 in the side of the boss 60. Optionally, the features 66, in cooperation with the ferrule 40, include elements to prevent reciprocation and rotation of the ferrule 40 within the boss 60.

Figure 38:
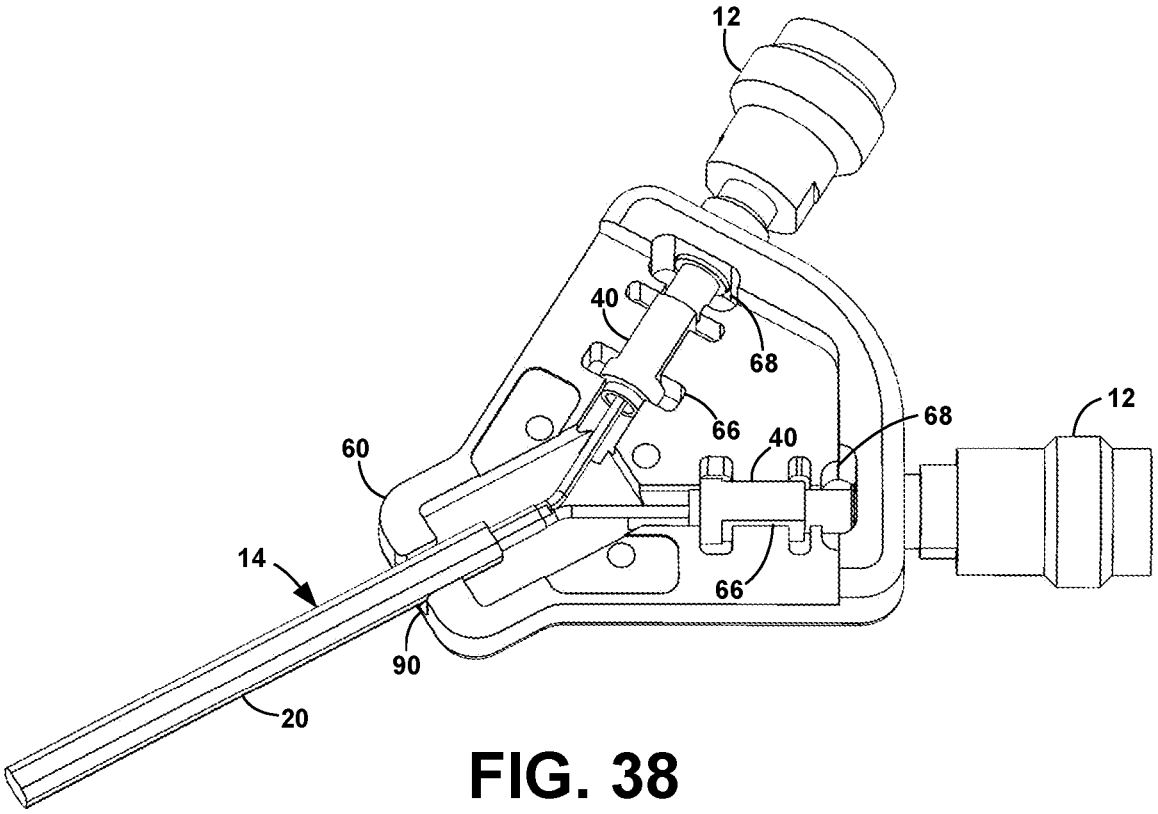
FIG. 38 is an isometric view of the boss.
Figure 40:
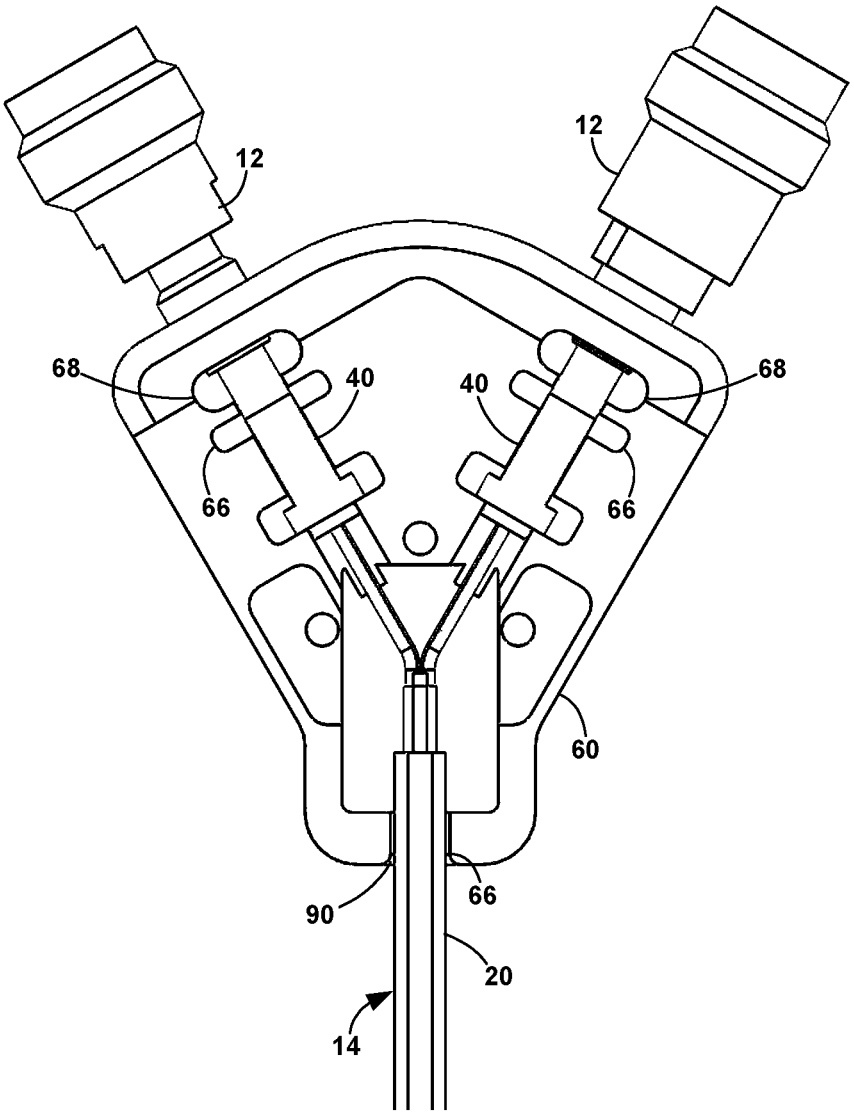
FIG. 40 is a front view of the boss with the cable subassembly installed.

The features 66 in the present design, shown in FIG. 38, include a depression 72 in the boss 60 with a wide portion 74 at one end adjacent to an elongated portion 76. The wide portion 74 can be round or rectangular in cross-section. The elongated portion 76 is rectangular in cross-section with opposed, parallel walls 78.

As shown in FIGS. 15-17, the capture section 80 of the ferrule 40 has a complementary configuration with a larger diameter than the cylindrical SMA barrel attachment section 82. The capture section 80 has a pair of opposed, parallel flat walls 86 that extend along a portion of the capture section 80 adjacent to the SMA barrel attachment section 82, leaving a cylindrical foot 84 near the line end 48. The foot 84 fits into the wide portion 74 of the depression 72 and the flat walls 86 fit into the elongated portion 76 of the depression 72 abutting the opposed walls 78. The foot 84 in the wide portion 74 prevents the ferrule 40 from reciprocating in the depression 72 and the flat walls 86 abutting the opposed walls 78 prevent the ferrule 40 from rotating in the depression 72.

Optionally, the boss 60 includes features for clamping the two parts 40*a*, 40*b* of a two-part ferrule 40 together.

Once the cable subassembly 14 is positioned in the boss 60, each SMA connector barrel 12 is attached to the SMA barrel attachment section 82 of the ferrule 40 through the opening 68 by whatever means is appropriate. The SMA barrel attachment section 82 is configured for the particular type of SMA connector barrel 12 that will be attached. The attachment can be permanent, but is preferably removable. IN one configuration, the SMA barrel attachment section 82 is threaded so that the SMA connector barrel 12 screws onto the ferrule 40. In another configuration, the SMA connector barrel 12 is press-fit onto the SMA barrel attachment section 82. In another configuration, the SMA connector barrel 12 has an outside thread that screws into the connector opening 68 and slides onto the SMA barrel attachment section 82.

The ferrule 40 enables the subassembly 14 to be properly positioned and rigidly held by the boss 60 so that the union of the cable 20 and SMA connector barrel 12 consistently provides the best signal integrity. The trimmed face 50 of the ferrule 40 provides a flat and predictable interface geometry with which the mating SMA connector can mate.

Figure 41:
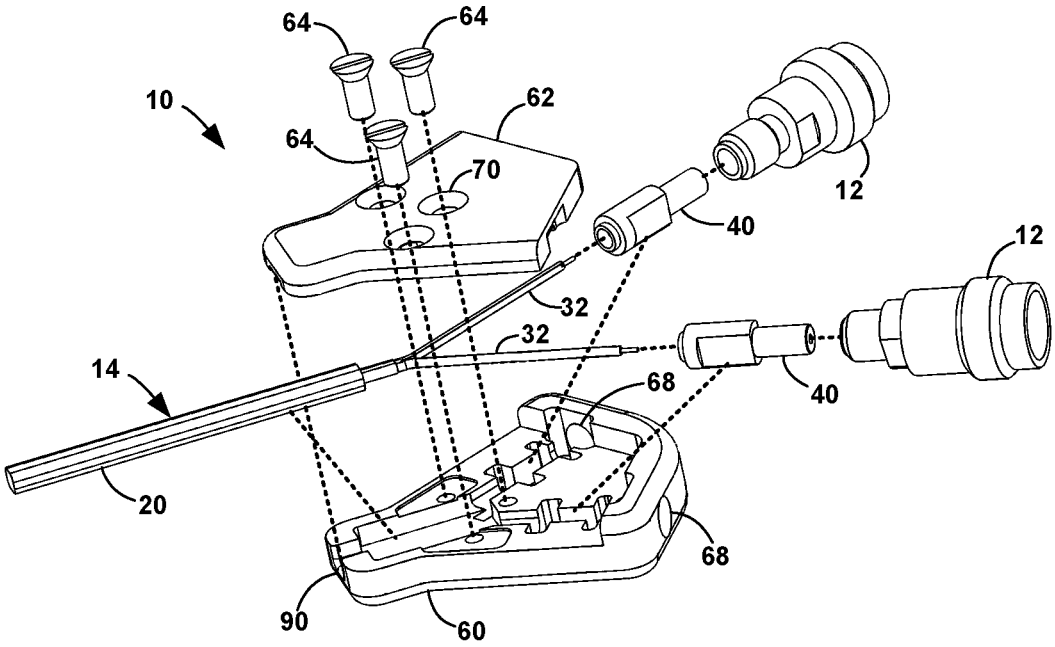
FIG. 41 is an exploded view of the termination assembly.
Figure 42:
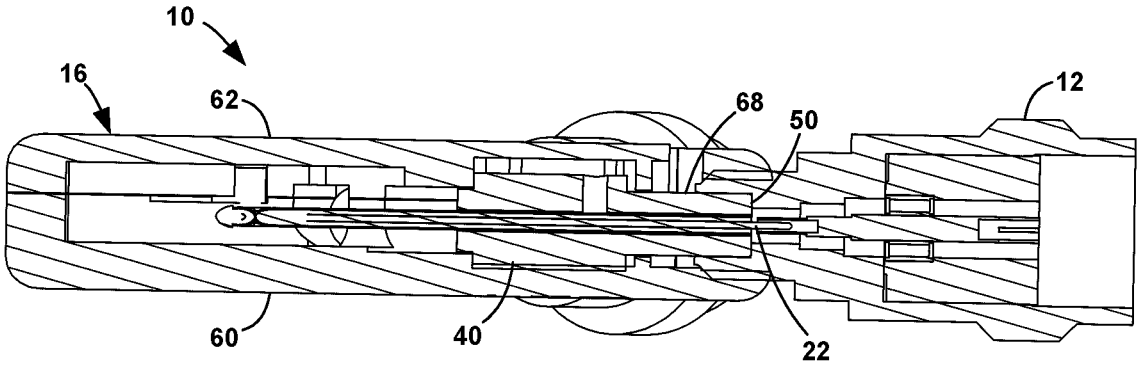
FIG. 42 is a cross-sectional view of the termination assembly taken at 42-42 of FIG. 6.

After the SMA connector barrels 12 are mated to the ferrules 40 in the boss 60, the cover 62 is placed on the boss 60 and attached with screws 64 through holes 70 in the cover 62, as shown in FIG. 41, or by other mechanical means to form the complete termination assembly 10 shown in FIGS. 1-7. In order to minimize stresses on the cable 20, the cable 20 is pinched between the boss cable opening 90 and the cover 62. Optionally, the cable 20 is wrapped at the pinch point with additional material, such as sheath material, in order to add rigidity and to prevent too much bending where the cable 20 exits the housing 16.

The boss 60 grabs and holds the cable subassembly 14 by the ferrules 40, thereby minimizing the stress on the junction between the ferrule 40 and the shielded line 32. That is, there is no pulling, pushing, or bending forces on the shielded line 32 where it enters the ferrule 40, forces that can detrimentally change the electrical characteristics, such as the impedance, of the junction. The result is a stable electrical junction between the foil shield cable 20 and the SMA connector barrel 12 that can be mated and unmated several times without changing the electrical characteristics of the transmission line.

The integrated ferrule embodiment 210, shown in FIGS. 43-52, can be used with any cable structure, including those with separate foil shields 26 or one foil shield and separate dielectrics 24 or one dielectric 24.

Briefly, the sheath 28 is stripped back and the foil shield 26 is stripped back a bit less. If the cable 20 has separate dielectrics 24, the dielectrics 24 are not stripped back leaving each line 30 and forming the cable subassembly 214. If the cable 20 has a single dielectric 24, the dielectric 24 is stripped back with the foil shield 26 and dielectric sleeves 220 are slid over the signal conductors 22 to form lines 30, thereby forming the cable subassembly 214. The cable subassembly 214 is installed in the boss 224 of a housing 216 and secured by a cover 226 attached to the boss 224 by screws 228 or other mechanical means. SMA connector barrels 212 are attached to projections 232 from the boss 224 from which the signal conductors 22 extend.

The housing 216 provides a platform where the SMA connector barrels 212 can electrically attach to the cable 20 without stressing the cable 20.

Figure 43:
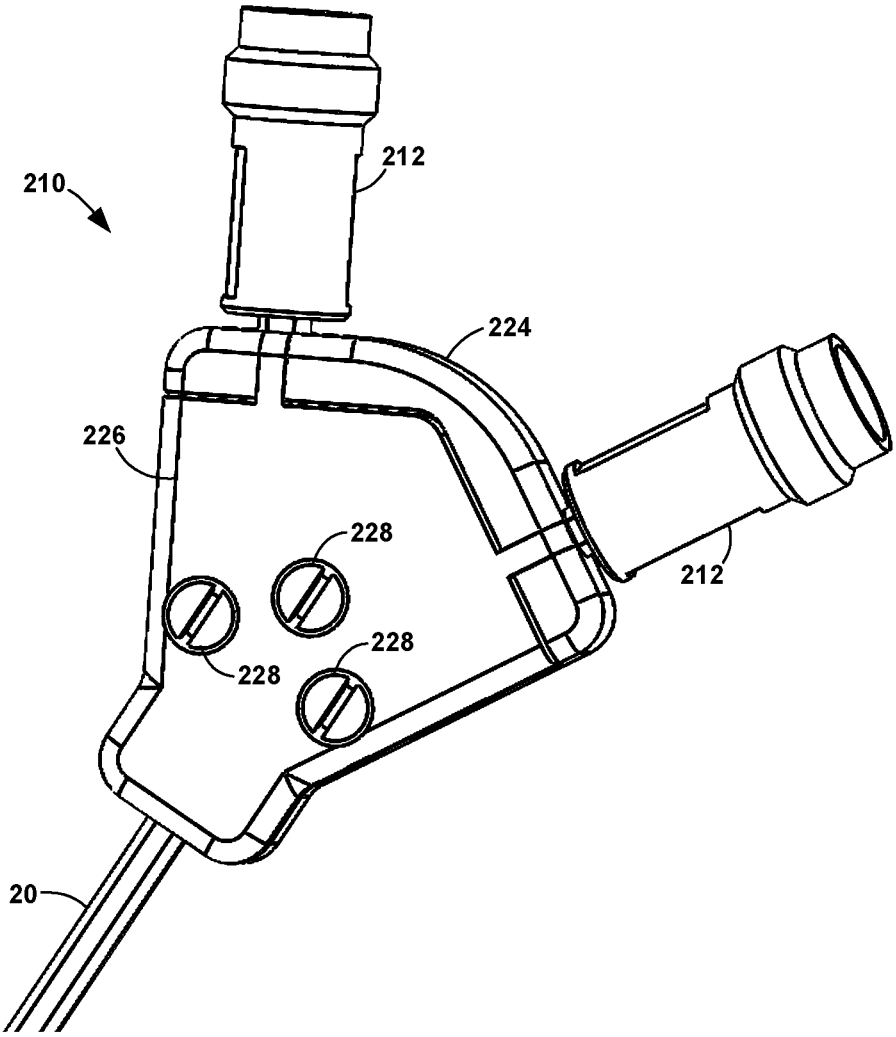
FIG. 43 is a rear, isometric view of the fully assembled termination assembly of the integrated ferrule embodiment of the present invention for a twin-ax cable.
Figure 44:
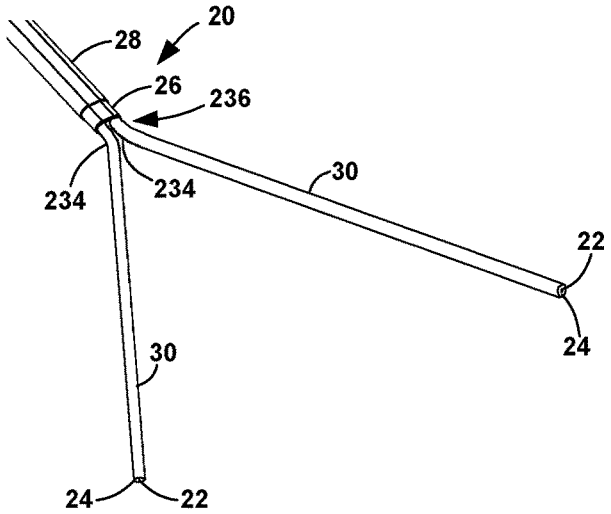
FIG. 44 is a view of the separate-dielectric twin-ax cable after preparation as the cable subassembly.

FIG. 43 shows the fully assembled cable termination assembly of the integrated ferrule embodiment 210 of the present invention with SMA connector barrels 212. The present specification describes the termination of the present invention as used with a twin-ax cable 20, but can be adapted for use with cables 20 having one or more signal conductors 22.

The cable subassembly 214 is assembled by first stripping back the sheath 28 to expose the foil shield(s) 26 wrapped around the dielectric(s) 24. The next steps depend on the cable structure. For cables 20 with separate dielectrics 24, the foil shield 26 is stripped back somewhat less than the sheath 28 to expose the dielectrics 24, as in FIG. 44. As above, each signal conductor 22/dielectric 24 combination is denoted a line 30. The length that the sheath 28 and foil shield 26 are stripped back will depend on the particular application and the parameters of the housing 216, as described below. The lines 30 are bent away from each other, as at 234, at an angle described below to form the cable subassembly 214. That section of the cable 20 to where the foil shield 26 is stripped back and the lines 30 bent apart is referred to as the junction 236.

Figure 45:
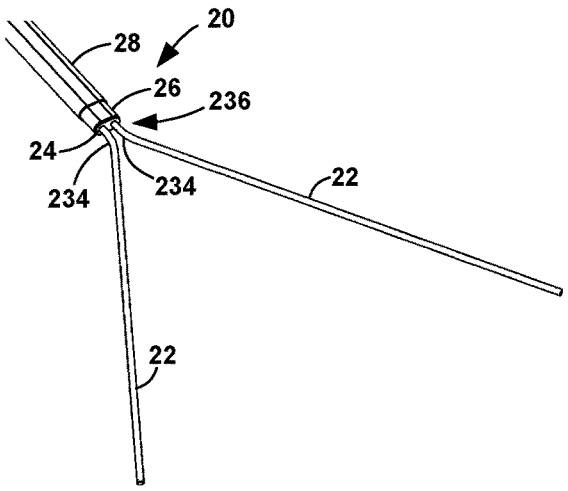
FIG. 45 is a view of the single-dielectric twin-ax cable after preparation for assembling the cable subassembly.

For cables with a single dielectric 24, the foil shield 26 and dielectric 24 are stripped back somewhat less than the sheath 28 to expose the signal conductors 22, as in FIG. 45. The length that the sheath 28, foil shield 26, and dielectric 24 are stripped back will depend on the particular application and the parameters of the housing 216, as described below. The signal conductors 22 are bent away from each other, as at 234, at an angle described below. As above, that section of the cable 20 to where the foil shield 26 and dielectric 24 are stripped back and the signal conductors 22 bent apart is referred to as the junction 236.

The single dielectric cable subassembly 214 is assembled by sliding a dielectric sleeve 220 onto each signal conductor 22. The dielectric sleeve 220 is cylindrical with an axial through hole 222 for the signal conductor 22. The dielectric sleeve 220 is long enough to cover most of the signal conductor 22, as described below. The cable subassembly 214 is ready to be installed into the housing 216.

The housing 216 includes a boss 224 and a cover 226 that are both composed of rigid materials. The boss 224 is composed of an electrically conductive material to operate as the ground return. The cover 226 can be composed of either an electrically insulating or conductive material. The latter makes for a better EMI shield and as a continuation of the ground return. The boss 224 and cover 226 can be composed of an insulating material if they are coated with a conductive material such as metal plating.

Figure 47:
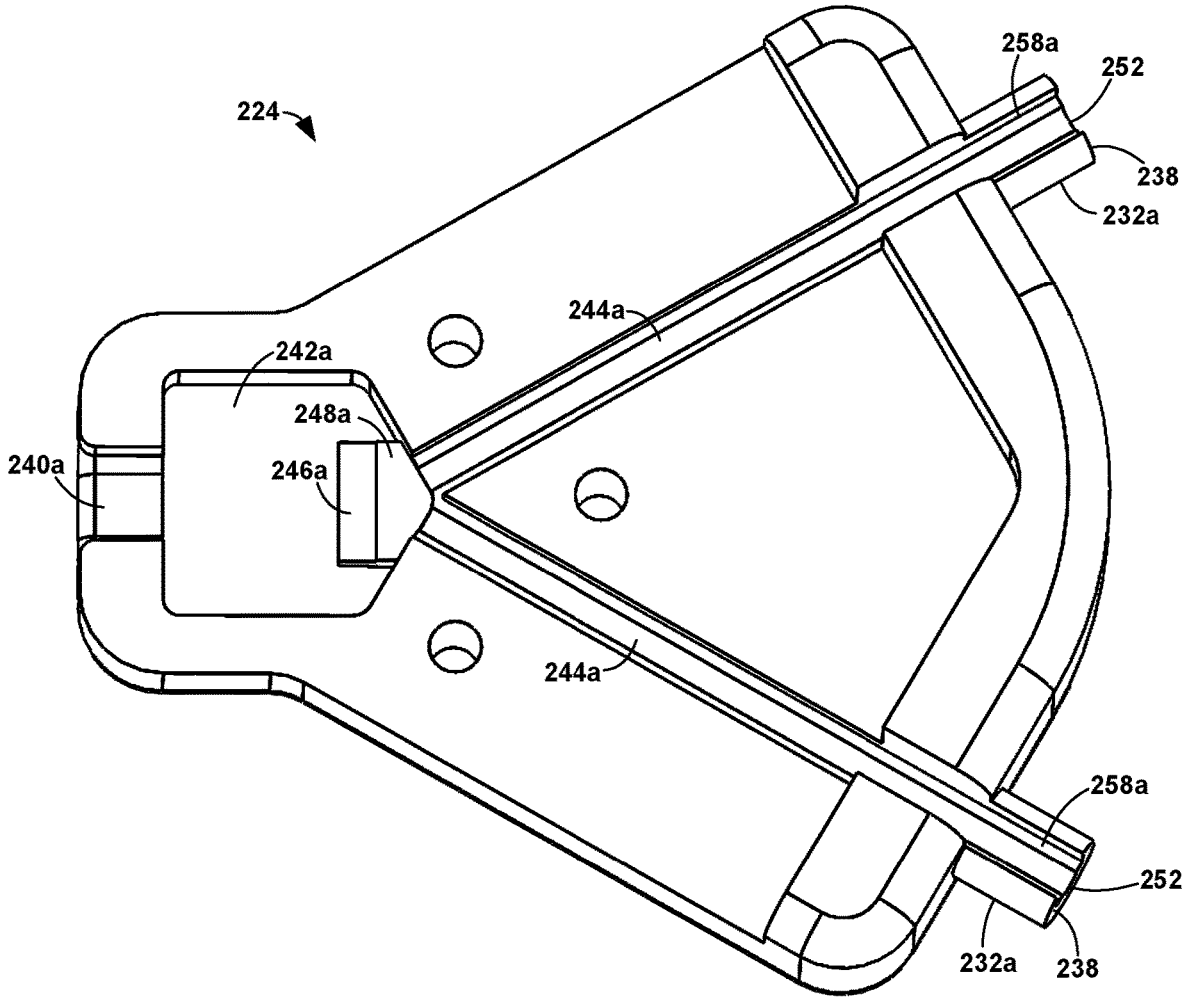
FIG. 47 is an isometric view of the boss.
Figure 48:
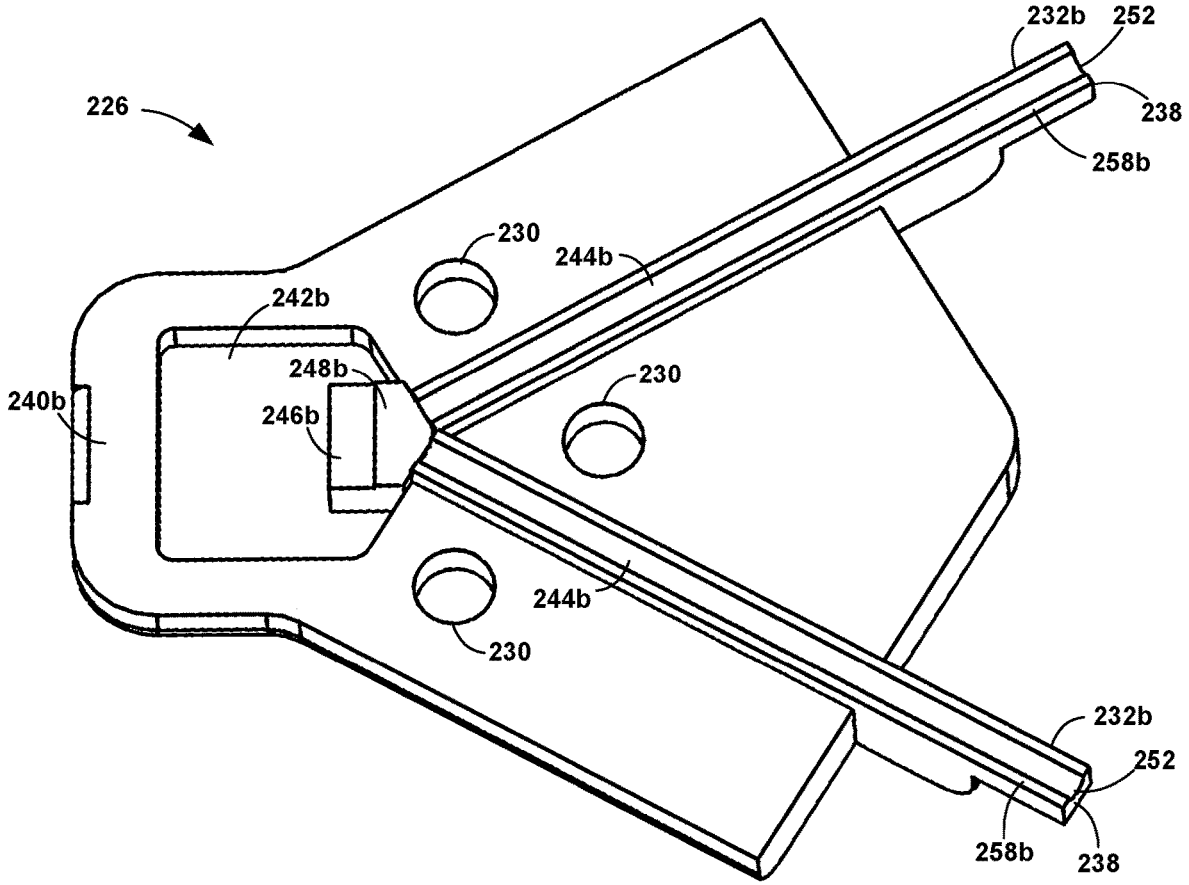
FIG. 48 is an isometric view of the cover.
Figure 49:
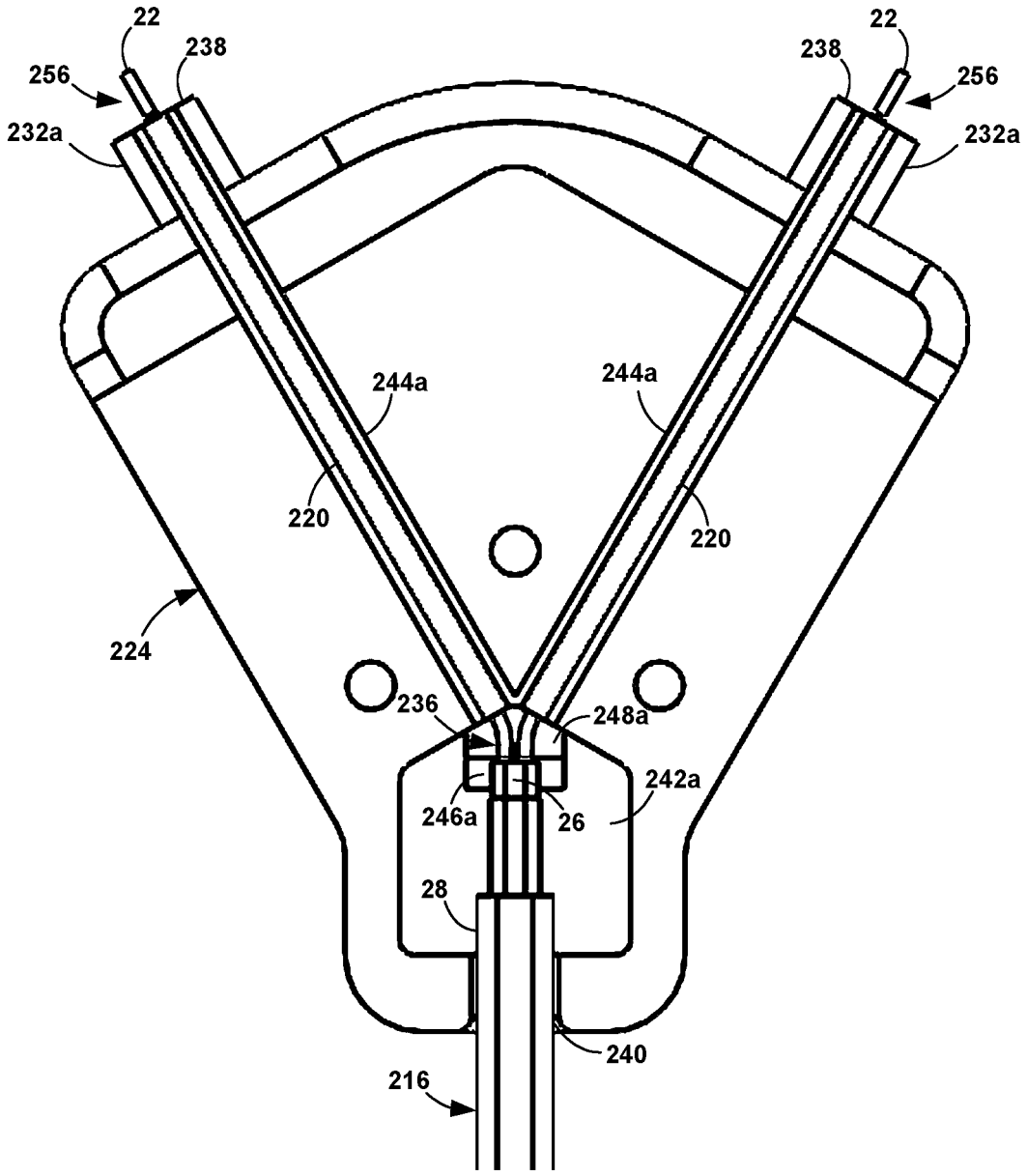
FIG. 49 is an isometric view of the boss with the cable subassembly installed.

As shown in FIG. 47, the boss 224 has several depressions for receiving the cable subassembly 214. Each of the boss depressions has a corresponding depression in the cover 226, shown in FIG. 48, the combination of which form spaces in the housing 216 through which the cable subassembly 214 extends. The sheathed cable 20 fits into a strain relief 240, formed by a depression 240*a* in the boss 224 and a depression 240*b* in the cover 226, at one end of the housing 216. The strain relief 240 opens into a junction space 242, formed by a depression 242*a* in the boss 224 and a depression 242*b* in the cover 226, which accepts the cable junction 236. Signal runs 244, formed by a depression 244*a* in the boss 224 and a depression 244*b* in the cover 226, extend away from the junction space 242 at an angle to each other that depends on the particular application. In the present design, the angle is approximately 60°. This is the same angle that the lines 30/signal conductors 22 are bent away from each other when assembling the cable subassembly 214. The signal runs 244 extend through the projections 232, formed by a finger 232*a* extending from the boss 224 and a finger 232*b* extending from the cover 226, that extend from the edge of the boss 224 to openings 252 in the projection faces 238.

Figure 50:
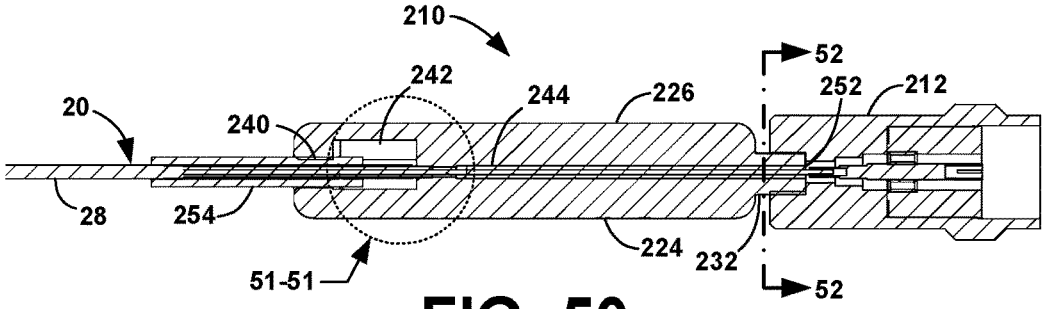
FIG. 50 is a cross-sectional view of the assembled housing with the cable.
Figure 51:
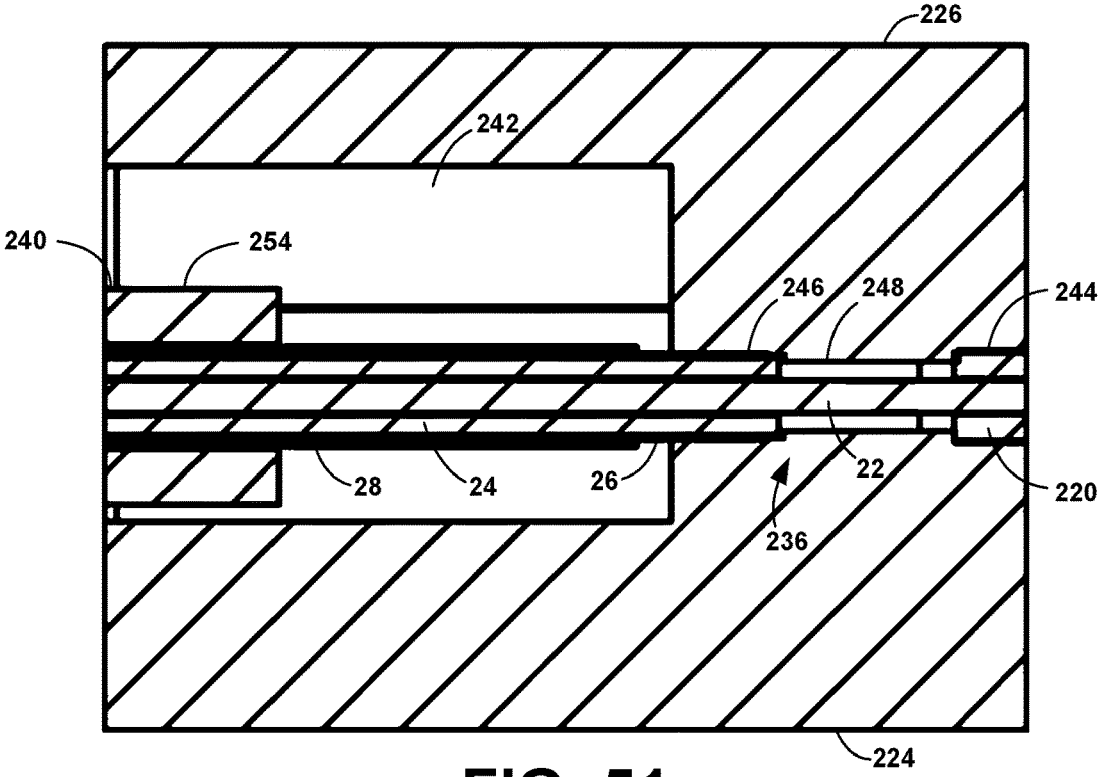
FIG. 51 is a detailed cross-section taken at 51-51 of FIG. 50.

As shown in FIGS. 50-51, the cable 20 is captured in the strain relief 240 when the cover 226 is attached to the boss 224. Optionally, the cable 20 is wrapped with additional material 254 at the strain relief 240, such as sheath material, in order to add rigidity and to prevent too much bending where the cable 20 exits the housing 216.

The cable 20 extends into the junction space 242 to a neck 246 that receives the foil shield 26. The foil shield 26/dielectric 24 are compressed between the boss neck 246*a* and the cover neck 246*b* to provide a good electrical connection between the foil shield 26 and the housing 216.

The line/signal conductor bends 234 are received by a throat 248 composed of a depression 248*a* in the boss 224 and a depression 248*b* in the cover 226, which is slightly narrower than the neck 246 to compensate for air dielectric and control the impedance in the throat area.

The signal runs 244 are cylindrical with a diameter complementary to the dielectric 24/dielectric sleeves 220. With the separate dielectric cable 20, the line 30 extends somewhat beyond the projection face 238, as at 256 in FIG. 49. With the single dielectric cable 20, the dielectric sleeve 220 extends the complete length of the signal run 244 until flush with the projection face 238 and the signal conductor 22 extends somewhat beyond the projection face 238, as at 256 in FIG. 49.

As described above, when signal conductors 22 of the cable 20 with a single dielectric 24 are separated, the single dielectric 24 would have to be split between the two signal conductors 22. If that happened, the dielectric 24 would no longer be complete, that is, it would no longer provide the correct impedance. To alleviate this problem, the dielectric 24 is stripped back to the junction 236 with the foil shield 26 and the dielectric sleeves 220 are slid onto the exposed signal conductors 22. The outside diameter of the dielectric sleeve 220 and the inside diameter of the signal run 244 are designed to provide the proper impedance and to operate similarly to the cable 20 with separate dielectrics 24.

Figure 46:
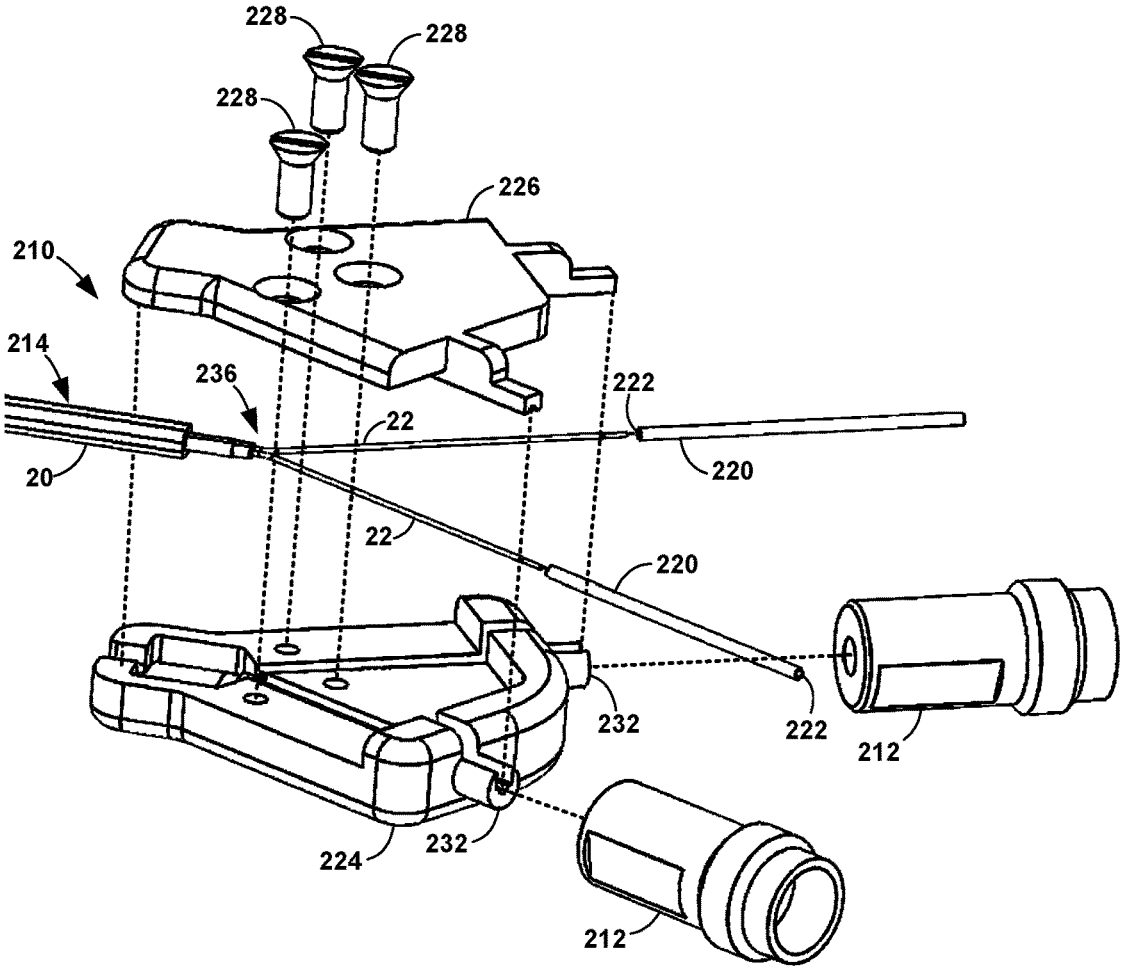
FIG. 46 is an exploded view of the termination assembly.

Once the cable subassembly 214 is positioned in the boss 224, the cover 226 is placed on the boss 224 and attached with screws 228 through holes 230 in the cover 226, as shown in FIG. 46, or by other mechanical means, thereby enclosing the strain relief 240, junction space 242, neck 246, throat 248, and signal runs 244.

Figure 52:
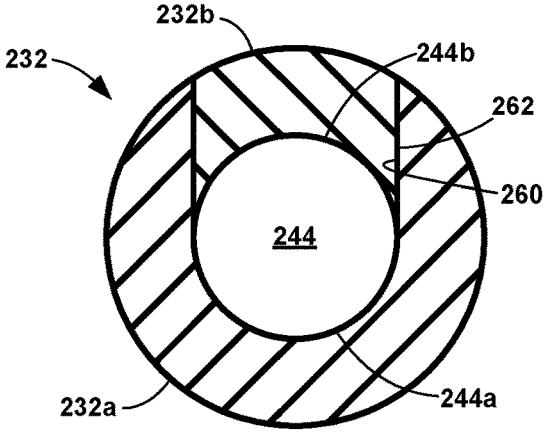
FIG. 52 is a cross-section of a configuration of the projection taken at 52-52 of FIG. 50.

As can be seen in FIG. 46, the projections 232 are comprised of a finger 232*a* extending from the boss 224 and a finger 232*b* extending from the cover 226. In the same way that the two parts 40*a*, 40*b* of the two-part ferrule 40 come together to form the complete ferrule 40, the two fingers 232*a*, 232*b* come together to form the complete projection 232 when the cover 226 is attached to the boss 224. As with each part 40*a*, 40*b* of the two-part ferrule 40, the fingers 232*a*, 232*b* have abutting surfaces 258*a*, 258*b* that complement each other. The present invention contemplates any appropriate shape of complementary abutting surfaces 258*a*, 258*b* can be used, including those shapes described above with reference to the two-part ferrule 40. Another example of complementary abutting surfaces 258*a*, 258*b* is shown in FIG. 52. The boss 224 has 180° of the signal run 244 and extending parallel tangential walls 260. The cover 226 has the other 180° of the signal run 244 and flat parallel walls 262. The cover finger 232*b* slides into the boss finger 232*a* to complete the projection 232.

After the cover 226 is attached, for the separate dielectric 24, the dielectric 24 is dressed so that it is flush with the projection face 238. Optionally, for all cables 20, the projection face 238 is dressed by precise trimming to set the electrical length or phase of the cable 20. Trimming the face 238 makes the shield 26 electrically shorter. The two lines 30 of a twin-ax cable 20 can be precisely matched so that they have the same or specified different electrical length or phase length, as desired.

After trimming and/or dressing, the SMA connector barrels 212 are attached to the projections 232, as in FIG. 43, by whatever means is appropriate. The projections 232 function similarly to the ferrules 40 of the previous embodiment 10. The projections 232 are configured for the particular type of SMA connector barrel 212 that will be attached. The attachment can be permanent, but is preferably removable. Typically, the projection 232 is threaded so that the SMA connector barrel 12 screws onto the projection 232. Alternatively, the SMA connector barrel 12 is press-fit onto the projection 232.

The boss 224 enables the cable subassembly 214 to be properly positioned and rigidly held so that the union of the cable 20 and SMA connector barrel 212 consistently provides the best signal integrity. The projection face 238 provides a flat and predictable interface geometry with which the mating SMA connector can mate.

Thus, it has been shown and described a controlled impedance cable termination for cables having conductive foil shields. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. A method for terminating a controlled impedance cable having one or more signal conductors, a dielectric surrounding the signal conductor, and a ground path composed only of a foil shield surrounding the dielectric, the method comprising the steps of:

(a) providing a ferrule for each signal conductor, the ferrule composed of a rigid material, and having an axial through bore extending from a line opening to a face opening in a ferrule face, the ferrule having a capture section adjacent to the line opening and an SMA barrel attachment section adjacent to the ferrule face;

(b) assembling a cable subassembly by (1) forming each signal conductor into a shielded line, (2) installing the ferrule on the shielded line such that the signal conductor protrudes from the face opening; (3) securing the ferrule to the shielded line; and (4) dressing the ferrule face such that the foil shield and the dielectric are flush with the ferrule face to form a planar mating surface with the signal conductor protruding from the ferrule face;

(c) providing a boss composed of a rigid material that has features for capturing each ferrule such that the ferrule face is aligned with a connector opening in the boss;

(d) installing the cable subassembly in the boss by installing each ferrule in the corresponding features; and (e) attaching a rigid cover to the boss.

2. The method of claim 1 further comprising the step of, after installing the cable subassembly in the boss, attaching an SMA connector barrel to each ferrule through the connector opening.

3. The method of claim 1 wherein the ferrule is comprised of a single part and wherein installing the ferrule on the shielded line includes sliding an end of the shielded line into the line opening of the ferrule until the end of the shielded line extends from the face opening.

4. The method of claim 1 wherein the ferrule is comprised of a two longitudinal parts and wherein installing the ferrule on the shielded line includes placing the two longitudinal parts on the shielded line.

5. The method of claim 1 wherein the features and the ferrule have elements to prevent reciprocation and rotation of the ferrule in the boss.

6. The method of claim 1 wherein dressing the ferrule face includes trimming the ferrule face such that the shielded line is a desired length.

7. The method of claim 1 wherein the cable has more than one line and a single foil shield surrounding all dielectrics, the method further comprising the steps of, prior to sliding ferrules onto the shielded lines, splitting the foil shield into portions, one portion for each line, and wrapping each portion around the corresponding line to form the shielded lines.

8. The method of claim 1 wherein the cable has two lines and a length or a phase of the two shielded lines are matched by dressing the ferrule faces.

9. The method of claim 1 wherein assembling the cable assembly includes stripping back the dielectric and sliding a dielectric sleeve on the signal conductor.

10. The method of claim 1 wherein attaching the cover pinches the cable between the boss and the cover.

11. The method of claim 1 wherein the cable further comprises a sheath and, prior to sliding the ferrule onto the shielded line, trimming the sheath back.

12. The method of claim 1 wherein the boss is composed of an electrically insulating material.

13. The method of claim 1 wherein the boss is composed of an electrically conductive material.

14. The method of claim 1 wherein the ferrule is secured to the shielded line by a bonding agent.

15. The method of claim 14 wherein the bonding agent is introduced into the ferrule by a hole in the side of the ferrule that intersects the bore.

16. A termination assembly comprising:

(a) a controlled impedance cable having one or more signal conductors, a dielectric surrounding the signal conductor, and a ground return composed only of a foil shield surrounding the dielectric;

(b) a ferrule for each signal conductor, the ferrule composed of a rigid material, the ferrule having an axial through bore extending from a line opening to a face opening in a ferrule face, the bore receiving and securing the signal conductor with the dielectric and the foil shield, wherein the foil shield and the dielectric are flush with the ferrule face to form a planar mating surface with the signal conductor protruding from the ferrule face;

(c) a boss composed of a rigid material and that has features for capturing the ferrule such that the ferrule face is aligned with a connector opening in the boss; and a rigid cover attached to the boss.

17. The termination assembly of claim 16 further comprising an SMA connector barrel attached to the ferrule through the connector opening.

18. The termination assembly of claim 16 wherein the ferrule is comprised of a single part.

19. The termination assembly of claim 16 wherein the ferrule is comprised of two longitudinal parts.

20. The termination assembly of claim 16 wherein the features and the ferrule have elements to prevent reciprocation and rotation of the ferrule in the boss.

21. The termination assembly of claim 16 wherein the boss and the cover include elements that pinch the cable therebetween.

22. The termination assembly of claim 16 wherein the boss is composed of an electrically insulating material.

23. The termination assembly of claim 16 wherein the boss is composed of an electrically conductive material.

24. The termination assembly of claim 16 wherein the ferrule is secured to the signal conductor with the dielectric and the foil shield by a bonding agent.

25. The termination assembly of claim 24 wherein the ferrule includes a hole in a side of the ferrule that intersects the bore into which the bonding agent is introduced.

26. A method for terminating a controlled impedance cable having one or more signal conductors, a dielectric surrounding each signal conductor, and a ground return composed only of a foil shield surrounding the dielectric, the method comprising the steps of:

(a) assembling a cable subassembly by at least stripping back the foil shield;

(b) providing an electrically conductive housing having a strain relief, a junction space with a neck and a throat, and a signal run extending from the throat to a projection face of a cylindrical projection extending from an edge of the housing; and (c) installing the cable subassembly into the housing such that the cable enters via the strain relief, the foil shield is compressed in the neck, and each signal conductor with the dielectric extends through the throat into the signal run with the signal conductor protruding from the projection face.

27. The method of claim 26 further comprising the step of, after installing the cable subassembly in the housing, attaching an SMA connector barrel to each projection.

28. The method of claim 26 wherein assembling the cable subassembly further comprises stripping back the dielectric to expose the signal conductor and sliding a dielectric sleeve onto the signal conductor.

29. The method of claim 26 wherein the housing is comprised of a boss and a cover, and wherein the cable subassembly is installed in the boss and, after installation of the cable subassembly, the cover is attached to the boss to form the strain relief, the junction space, the neck, the throat, and the signal run, and the projection.

30. The method of claim 26 wherein the projection face is dressed.

31. The method of claim 26 wherein the cable has more than one signal conductor and wherein assembling the cable subassembly includes bending the signal conductors apart at an angle and wherein the signal runs extend from the throat at the same angle.

32. The method of claim 26 wherein the cable further comprises a sheath and assembling the cable subassembly includes trimming the sheath back and installing the cable subassembly in the housing includes capturing the sheath in the strain relief.

33. A termination assembly comprising:

(a) a controlled impedance cable having one or more signal conductors, a dielectric surrounding the signal conductor, and a ground return composed only of a foil shield surrounding the dielectric, the foil shield being stripped back;

(b) an electrically conductive housing having internal spaces that include a strain relief capturing the cable, a junction space adjacent to the strain relief receiving the cable where the foil shield is stripped back, a neck in the junction space compressing the foil shield and the dielectric for an electrical connection to the housing, and a signal run adjacent to the junction space receiving the signal conductor and the dielectric, the signal run extending from the junction space to a projection face of a cylindrical projection extending from an edge of the housing, the cylindrical projection being adapted to accept an SMA connector barrel.

34. The termination assembly of claim 33 wherein the housing is comprised of a boss and a cover each including parts of the housing such that, when the cover is attached to the boss, the strain relief, the junction space, the neck, the signal run, and the projection are formed.

35. The termination assembly of claim 33 wherein the SMA connector barrel is attached to the projection.

* * * * *